US008740341B2

(12) United States Patent
Miyahara

(10) Patent No.: US 8,740,341 B2
(45) Date of Patent: Jun. 3, 2014

(54) INKJET PRINTING APPARATUS

(71) Applicant: Canon Kabushiki Kaisha, Tokyo (JP)

(72) Inventor: Katsutoshi Miyahara, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/728,025

(22) Filed: Dec. 27, 2012

(65) Prior Publication Data

US 2013/0182030 A1 Jul. 18, 2013

(30) Foreign Application Priority Data

Jan. 17, 2012 (JP) ..... 2012-007311
Nov. 13, 2012 (JP) ..... 2012-249355

(51) Int. Cl.
*B41J 29/393* (2006.01)

(52) U.S. Cl.
USPC ..... 347/19; 347/9; 347/14

(58) Field of Classification Search
USPC ..... 347/5, 9, 12–14, 19, 40, 42
See application file for complete search history.

(56) References Cited

U.S. PATENT DOCUMENTS 7,537,304 B2 * 5/2009 Wu et al. ..... 347/19

FOREIGN PATENT DOCUMENTS

JP 2002-292843 A 10/2002

* cited by examiner

*Primary Examiner* — Juanita D Jackson
(74) *Attorney, Agent, or Firm* — Fitzpatrick, Cella, Harper & Scinto

(57) ABSTRACT

An inkjet printing apparatus is provided that reduces a period required for detection of the ink ejection state for the individual ejection ports of a print head. The inkjet printing apparatus includes a carriage moving unit for moving a carriage in the main scan direction that crosses a conveyance direction in which a printing medium is to be conveyed. The inkjet printing apparatus also includes an LED and a photodiode, for receiving light emitted by the LED, both of which are employed to detect the ink ejection state for the ejection ports to be examined. The inkjet printing apparatus moves the LED and the photodiode in the main scan direction to move the inspection position, at which the ink ejection state is to be examined.

9 Claims, 11 Drawing Sheets

INKJET PRINTING APPARATUS

BACKGROUND OF THE INVENTION

1. Field of the Invention

The present invention relates to an inkjet printing apparatus that can detect, from among a group of ejection ports formed in a print head, an ejection port whereat the ejection process is being performed abnormally.

2. Description of the Related Art

To perform printing, an inkjet printing apparatus ejects ink droplets through ejection ports formed in a print head. In general, a plurality of these ink ejection ports are formed and arranged so ink is ejected through the ejection port formation face of a print head. Ejection port arrays are formed by the ejection ports are arranged in rows.

When an inkjet printing apparatus, equipped with a print head wherein ejection port arrays are arranged in this manner, has not been used for an extended period of time, ink in the periphery of the ejection ports may solidify and cause clogging. Therefore, ink ejection failures may occur at some of the ejection ports in the inkjet printing apparatus. If printing is performed without resolving ink ejection failures at some of the clogged ink ejection ports, there is a probability that white stripes will appear in those portions of a printed image that correspond to the positions of the ejection ports where ejection failures have occurred, and accordingly, this will degrade the quality of the image. In order to prevent the degradation of the quality of a printed image, when ejection failures have occurred among the ejection ports of a print head, all defective ejection ports must be detected. For when an ejection port where an ejection failure has occurred has been detected, action can be taken to eliminate the cause of the malfunction or to employ a supplementary procedure. For example, either a recovery operation for the detective ejection port is performed to recover the normal ejection of ink through the relevant ejection port, or, in place of the defective ink ejection port, another, normal ejection port is employed to perform the ejection of ink.

In Japanese Patent Laid-Open No. 2002-292843, an inkjet printing apparatus is disclosed wherein a sensor, employed to detect ejection ports where ejection failures have occurred, is so arranged that the trajectory of an ink droplet ejected through an ejection port is positioned between a light emitting portion and a light receiving portion of the sensor. In this inkjet printing apparatus, ink is ejected when light is emitted by the light emitting portion to the light receiving portion, and a change in the signal received by the light receiving portion is detected to identify an ejection port at which an ejection failure has occurred.

According to the inkjet printing apparatus disclosed in Japanese Patent Laid-Open No. 2002-292843, movement of the print head is continued until ejection ports at which the detection of ejection failures is performed are arranged at a location opposite a sensor that detects a defective ejection port. When the ejection ports for which the detection of ejection failures is to be performed are arranged at a position opposite that where the sensor is located, the ink ejection states of the individual ejection ports are examined. Therefore, a print head that is a comparatively large part must be accurately positioned at the location of the sensor used to detect the ink ejection states of the ejection ports.

Recently, an inkjet printing apparatus has been especially introduced that is compatible with the printing of a comparatively large printing medium. Such an inkjet printing apparatus also employs a comparatively large print head to perform printing, and the load imposed for moving the large print head is accordingly increased. Especially, for aligning target ejection ports with the sensor, a fine adjustment of the positioning of the print head is performed by reducing the speed of the print head so as not to cause a print head overrun due to a comparatively large load. Therefore, an extended period of time is required for the fine adjustment of the positioning of the print head, and in all likelihood, a protracted period of time will be required to detect the ink ejection state of each ejection port.

SUMMARY OF THE INVENTION

While taking the above described problem into account, one objective of the present invention is to provide an inkjet printing apparatus that can reduce a period of time required to detect the ink ejection states of individual ejection ports of a print head.

According to an aspect of the present invention, there is provided an inkjet printing apparatus for performing printing on a printing medium comprising: a print head including an ejection port array including a plurality of ejection ports to eject ink; a scanning unit, on which the print head is mounted to perform scanning in a first direction; an examination unit, including a light source and a light receiving device, for receiving light emitted by the light source, so as to be able to perform examination of an ink ejection state for a target ejection port based on an output change of the light receiving device when an ink droplet ejected from the target ejection port is passed between the light source and the light receiving device; and an inspection position moving unit on which the examination unit is mounted, for moving in the first direction, wherein the inspection position moving unit has positioning accuracy higher than that of the scanning unit.

According to the present invention, in a reduced period of time, the detection unit for detecting the ink ejection state of each ejection port can be arranged at the position whereat the ejection ports, for which the detection process is to be performed, are located. Therefore, the period of time required for the detection of the ejection condition of the print head can also be reduced. Thus, the printing efficiency can be improved.

Further features of the present invention will become apparent from the following description of exemplary embodiments (with reference to the attached drawings).

DESCRIPTION OF THE EMBODIMENTS

Figure 1:
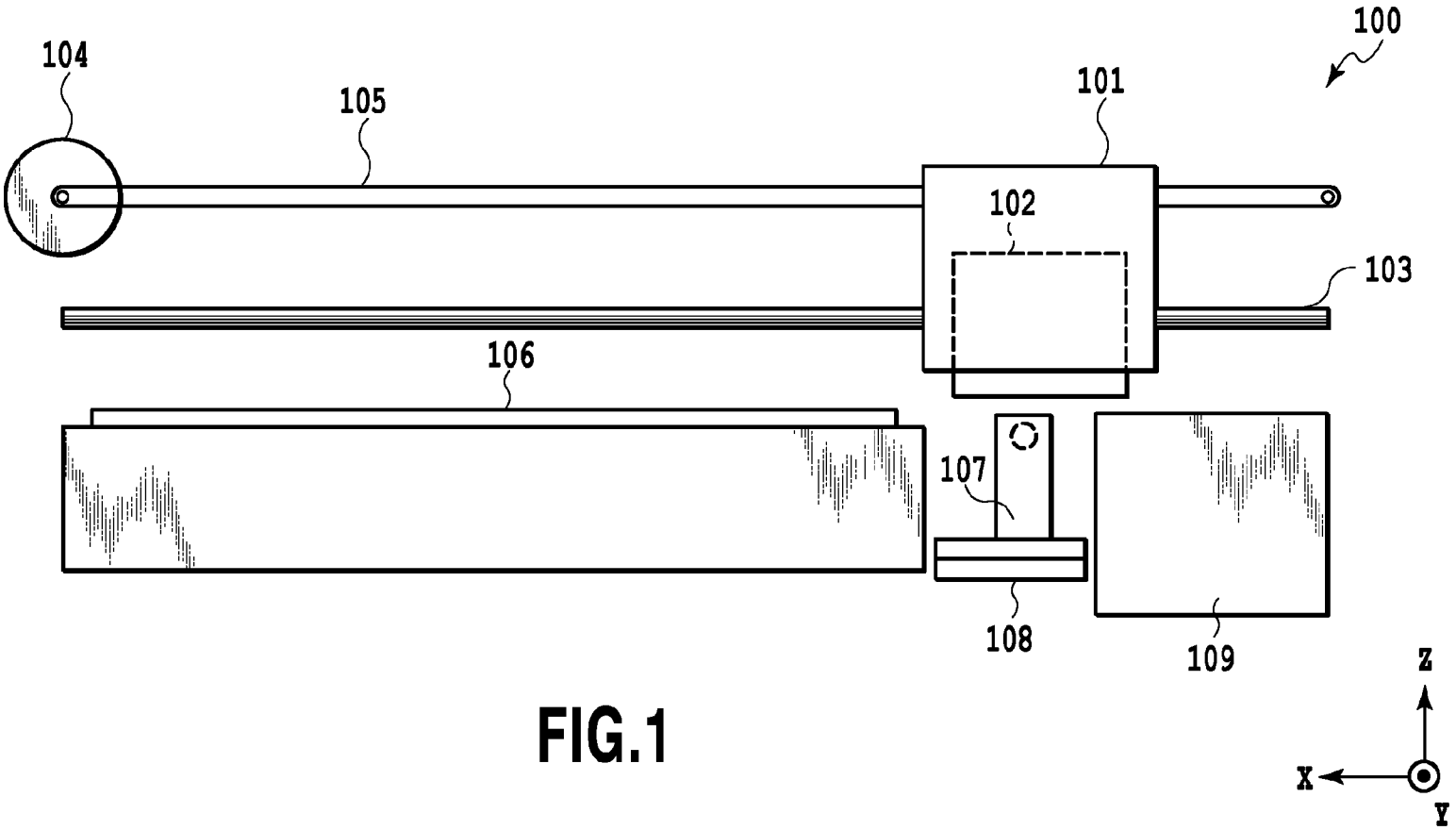
FIG. 1 is a schematic front view of the structure of the essential portion of an inkjet printing apparatus according to a first embodiment of the present invention.

The embodiments of the present invention will now be described while referring to the drawings. It should be noted, however, that the components described in these embodiments are merely examples, and the scope of the present invention is not limited to these components.

An inkjet printing apparatus that performs printing by ejecting ink is employed as an example for the description of the following embodiments. However, the inkjet printing apparatus for the present invention is not limited to this type. The present invention can also be applied for a multi-functional machine that has a copy function and a scan function, i.e., a so-called multi-functional printer. Further, various inkjet printing systems can be employed, such as a system employing heat generators, a system employing piezoelectric elements, a system employing electrostatic elements and a system employing MEMS elements.

First Embodiment

FIG. 1 is a front view of the structure of the essential portion in the carriage area of an inkjet printing apparatus (hereinafter, referred also as a printing apparatus) 100 according to a first embodiment of the present invention. A carriage 101 is configured so that the carriage 101 can mount a print head 102, and the print head 102 is configured so that the print head 102 is attached to the carriage 101 to be detachable. Ink tanks (not shown) are employed to supply ink of individual colors to the corresponding portions of the print head 102. The carriage 101 is guided along a shaft 103. When the carriage conveying belt 105 is rotated by the carriage motor 104, the carriage 101 is reciprocally moved, in the main scan direction (X direction) above a platen 106. The inkjet printing apparatus includes the carriage motor 104 and the carriage conveying belt 105 as carriage moving means for moving the carriage 101 in the main scanning direction.

The inkjet printing apparatus 100 also includes conveying means for conveying a printing medium in a conveyance direction. The printing medium like a sheet is conveyed by conveying rollers (not shown) across the platen 106 in the sub-scan direction (Y direction) perpendicular to the main scan direction. The inkjet printing apparatus 100 performs the conveying operation for conveying a printing medium and the printing operation for moving the print head 102 in a direction that intersects the conveyance direction of the printing medium, and at the same time, ejecting ink to the printing medium from the ejection ports. When these operations are alternately performed by the inkjet printing apparatus 100, printing on the printing medium is performed. In this embodiment, the print head 102 is moved in the direction perpendicular to the conveyance direction in which the printing medium is to be conveyed.

The platen 106 is arranged at the position opposite the print head 102. When the print head 102 ejects ink to a printing medium that is set on the platen 106, printing is performed. A detector (detection means) 107 for optically detecting an ink droplet that passes through is provided at the position adjacent to the platen 106. Further, a recovery unit 109 is arranged at the portion adjacent to the detector 107, and has a mechanism for covering the ejection ports of the print head 102 with a cap to prevent ink of the print head 102 from being dry when the print head 102 is not in use. The recovery unit 109 also includes a suction mechanism for applying a negative pressure through the ejection ports to inside the print head 102 to draw in the ink inside the print head 102 via the ejection ports. When ink in the print head 102 is drawn in by the suction mechanism of the recovery unit 109, viscous ink and dust in the print head 102 can be collected. As a result, clogging in the ejection ports of the print head 102 and reduction of the accuracy of dot landing positions can be avoided. Further, the recovery unit 109 includes an ink filling mechanism for filling the print head 102 with ink.

Figure 2:
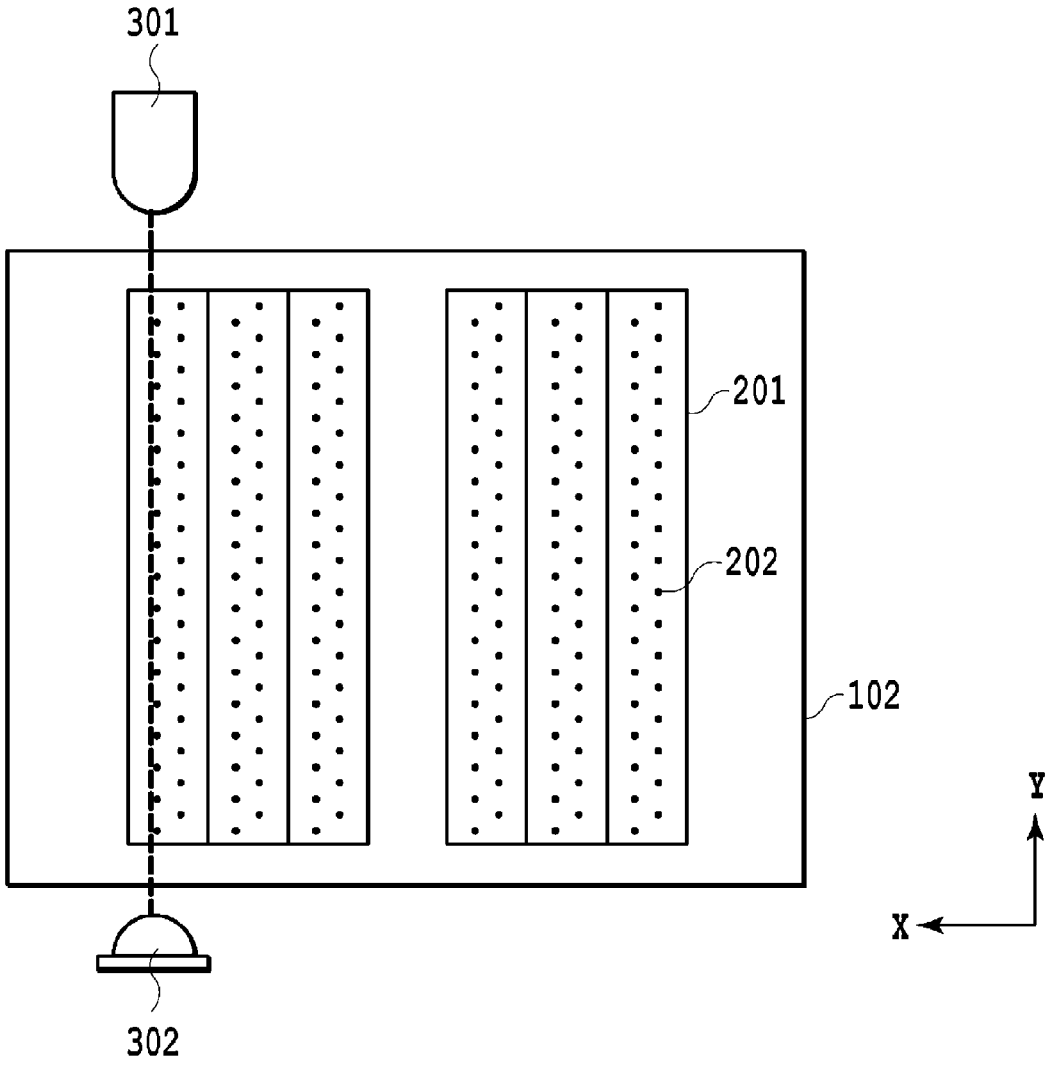
FIG. 2 is a plan view, from the platen side, of a print head employed for the inkjet printing apparatus in FIG. 1, and an LED and a photodiode for detecting the ink ejection state of the print head.

FIG. 2 is a diagram showing ejection port arrays formed in the ejection port formation face of the print head 102. As shown in FIG. 2, a plurality of ink ejection ports are formed in the print head 102. During printing, the ejection port formation face of the print head 102 where the ejection ports are formed is positioned opposite a printing medium. A plurality of (six, in this embodiment) chips 201 are arrayed in the main scan direction (X direction), and for each chip 201, two ejection port arrays are arranged. For each ejection port array 202, 640 ejection ports arranged at pitches of 600 dpi in the sub-scan direction (Y direction), and the two ejection ports are shifted from each other by half a pitch in the sub-scan direction. Therefore, each time the print head 102 moves in the main scan direction, printing at a resolution of 1200 dpi in the sub-scan direction can be performed. Ink of different colors can be supplied to the chips 201. In this embodiment, six color inks, i.e., C (cyan), M (magenta), Y (yellow), LC (light cyan), LM (light magenta) and K (black), are supplied respectively to the chips 201. As described above, the print head 102 includes the six chips 201, in each of which the two ejection port arrays 202 are formed to provide the total of 12 arrays 202. It should be noted that the two ejection port arrays 202 provided by each chip 201 are respectively called an EVEN array (even numbered array) and an ODD array (odd numbered array).

Figure 3:
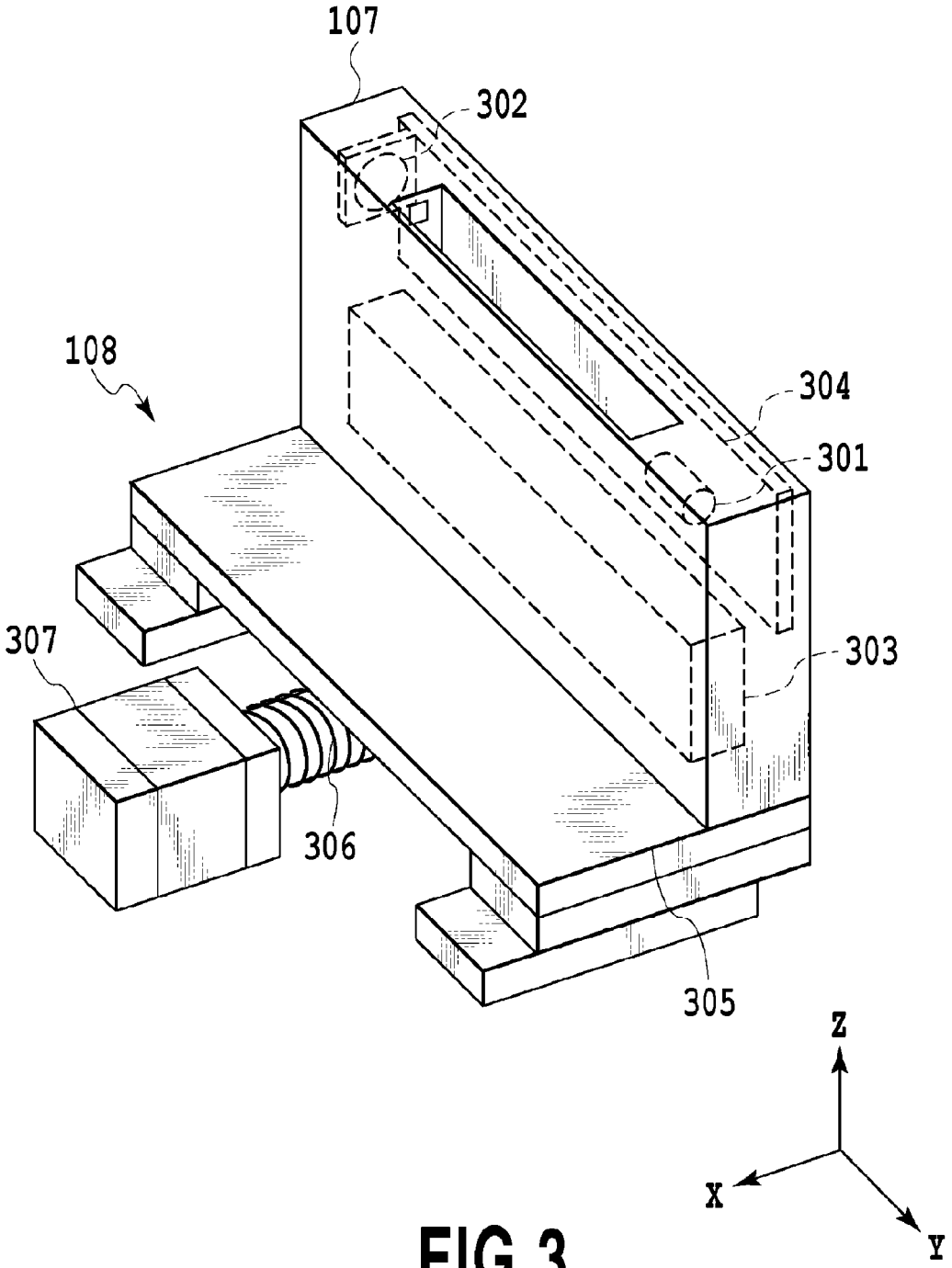
FIG. 3 is a perspective view showing a detector, for detecting the ink ejection state of the print head in FIG. 2, and a state for the moving of the detector.

FIG. 3 is a perspective view of a detector 107 and a stage 108 which can transfer the detector 107. The detector 107 includes an LED 301 that is a light source, a photodiode 302 that is a light receiving device, an ink absorber pad 303 and a detection circuit 304. The LED 301 and the photodiode 302 are arranged at locations opposite each other.

The LED 301 can be employed as a light emitting device for irradiating light, while the photodiode 302 can be employed as light receiving device for receiving light that is emitted by the LED 301. The central axis of a luminous flux, which is generated by the LED 301 for detection, is positioned almost at the same level, in the direction of height (Z direction), as the printing face of a printing medium that is set on the platen 106. In this embodiment, the distance between the LED 301 and the photodiode 302 is set slightly greater than the length of the ejection port array 202 of the print head 102 in the sub-scan direction (conveyance direction).

When examination of the ink ejection state is to be performed for target ejection ports, the detector 107 is positioned so that ink ejected via these ejection ports will cross the light axis between the LED 301 and the photodiode 302. When ink droplets ejected from the target ejection ports have crossed the light axis between the LED 301 and the photodiode 302, the output of the photodiode 302 is changed, and this output change is detected. Based on this output change of the photodiode 302, the ejection state of the target ejection ports can be examined. The detection process is performed in this manner to determine whether ink droplets have been normally ejected from all of the ejection ports included in the ejection port array 202. Ink ejected from the individual ejection ports is absorbed by the ink absorbent pad 303 prepared in a waste ink reservoir, which is arranged immediately below the area where a luminous flux passes between the LED 301 and the photodiode 302. More specifically, the waste ink reservoir (collection unit) is provided for the inkjet printing apparatus, to collect ink that was ejected from the target ejection ports to examine the ink ejection state thereof, and crossed the inspection position where the ink ejection state is examined. The LED 301 and the photodiode 302 are connected to the detection circuit 304 to emit light and to transmit a signal generated by light that is emitted by the LED 301 and is received by the photodiode 302.

The stage 108 includes a table 305 which is employed to fix the detector 107, a threaded shaft 306 and a stage drive motor 307. The table 305 is screwed with the threaded shaft 306. The stage drive motor 307 is a stepping motor, and can rotate the threaded shaft 306 by turning the drive shaft of the motor. Further, when the threaded shaft 306 is rotated, the table 305 screwed with the threaded shaft 306 is moved in the X direction that is parallel to the direction in which the threaded shaft 306 is extended. When the stage drive motor 307 is driven in this manner, moving of the detector 107 mounted on the table 305 is enabled, and when the detector 107 is moved in the main scan direction, the inspection position at which the detector 107 examines the ink ejection state can also be moved. In this embodiment, the table 305, the stage drive motor 307 and the threaded shaft 306 are employed as inspection position moving means that moves the detector 107. The travel distance of the table 305 is linearly changed in accordance with the angle of rotation of the motor. In this embodiment, as the table 305 is moved, the detector 107 can move at a distance of ±2 mm in the X direction. Since this structure is employed for the stage 108 on which the detector 107 is mounted, the detector 107 can be accurately positioned at the location corresponding to target ejection ports, which will be described later. Here, the center position in the movable range of the detector 107 is defined as a default standby position, and this position is called a reference position.

Figure 4:
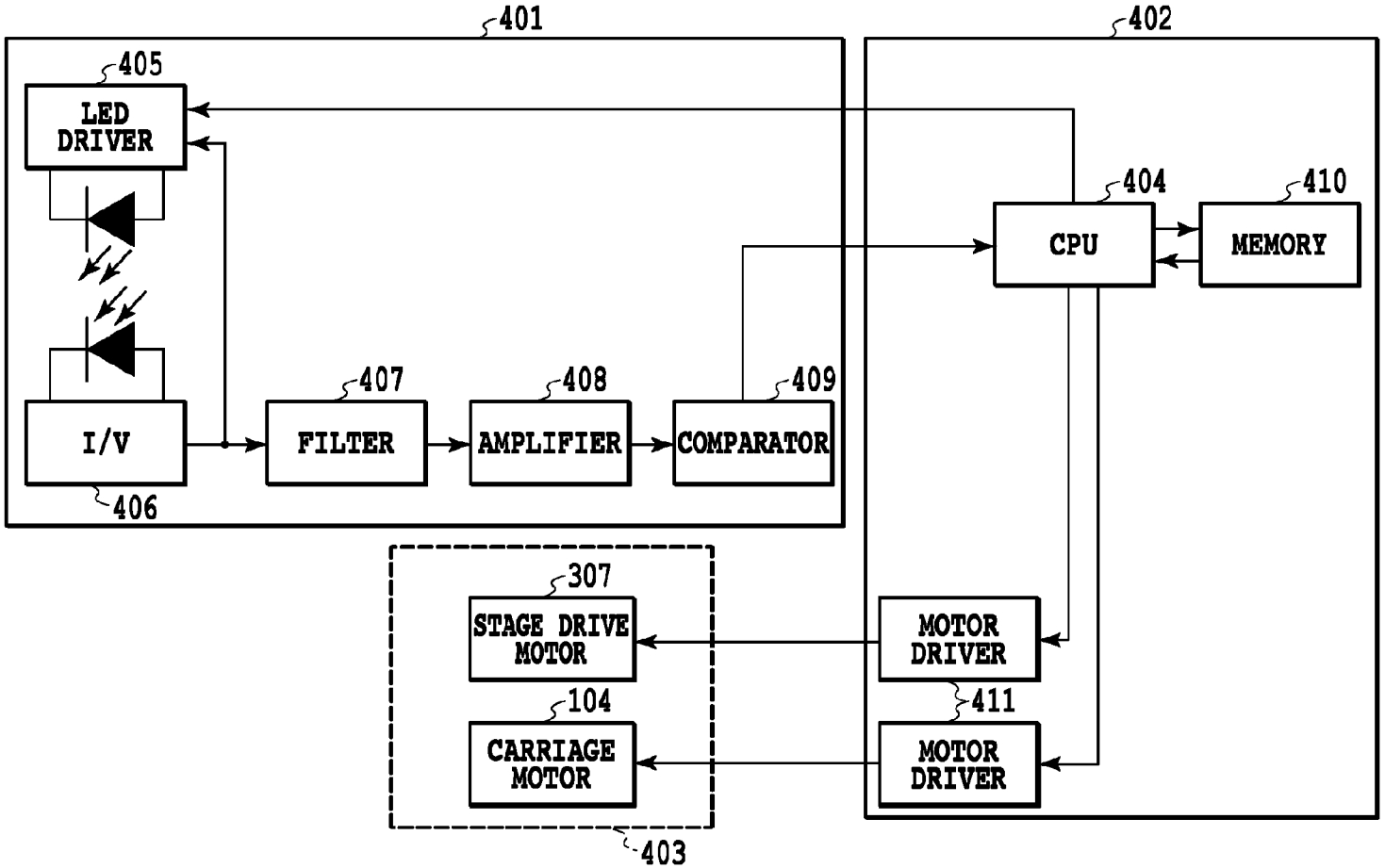
FIG. 4 is a block diagram illustrating the arrangement of the control system of the inkjet printing apparatus in FIG. 1.

FIG. 4 is a block diagram illustrating the control system, of the inkjet printing apparatus 100, centering around the detector 107. A detector block 401 is a block for the detection circuit 304 of the substrate that is mounted on the detector 107, a main body block 402 is the block of a detection circuit mounted on the main body of the inkjet printing apparatus 100. A motor block 403 is a block mounted on the inkjet printing apparatus 100 to drive the stage drive motor 307, connected to the main body block 402, and the carriage motor 104.

An LED driver 405 receives an instruction from a CPU 404, and drives the LED 301 to emit light. The photodiode 302 receives light emitted by the LED 301, and outputs a signal obtained from the light. The output from the photodiode 302 as a current signal is converted into a voltage signal in I/V converter 406. The LED driver 405 performs automatic adjustment for the drive current of the LED 301, so that the output obtained by the I/V converter 406 is maintained as a constant value. As a result, even when the property of the LED 301 changes as time elapses, constant output can be maintained. A filter circuit 407 extracts only the fluctuating component from the output of the I/V converter 406, and an amplifier 408 amplifies the level of the fluctuating component. A comparator 409 compares the amplified signal with the reference voltage. In the ejection state detection processing, when an ink droplet has crossed the passage area of detection light, the quantity of detection light received by the photodiode 302 is reduced. At this time, the output of the photodiode 302 is changed, and the level of a signal output by the amplifier 408 is reduced. When the ink droplet has cut off the detection light and thus, the signal level has become lower than the reference voltage level, the comparator 409 outputs, to the CPU 404, a detection signal indicating that the ink droplet has been detected. Upon receiving the detection signal, the CPU 404 stores the results in the storage area of a memory 410 at a location corresponding to the number of an ejection port, from which the ink droplet was ejected. When a change of the signal level greater than the reference value is detected, the normal ejection state is stored for the pertinent ejection port. When a detection signal is not output for an ejection port from which ink was ejected, an ejection failure is recorded for the pertinent ejection port. As described above, whether light emitted by the LED 301 has been received by the photodiode 302 is examined to determine whether ink was normally ejected from an ejection port. Motor drivers 411 for driving various motors, such as the carriage motor 104 and the stage drive motor 307, connected to the inkjet printing apparatus 100 are included in the main body block 402. In this embodiment, the CPU 404 permits the motor driver 411 to drive the carriage motor 104, and in this case, the CPU 404 serves as carriage moving control means for controlling the movement of the carriage 101 using the carriage motor 104.

(Correction Value Detection Processing for Aligning Print Head with Detector)

Figure 5:
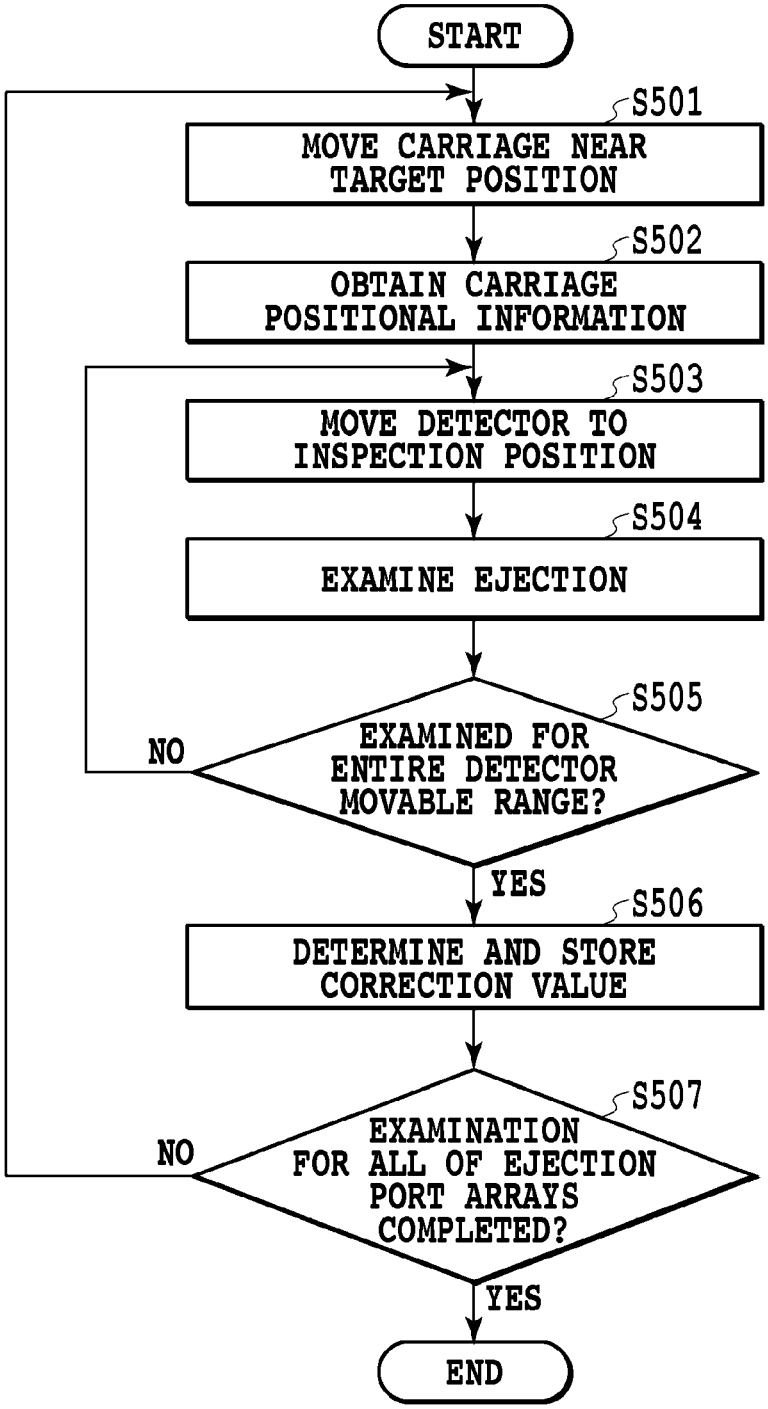
FIG. 5 is a flowchart showing the control processing performed by the inkjet printing apparatus shown in FIG. 1 to align the detection portion of the detector with detection target ejection ports of the print head.

The correction value detection processing for aligning the print head 102 with the detector 107 (hereinafter referred to as the correction value detection processing) will now be described by employing a flowchart in FIG. 5. FIG. 5 is a flowchart showing the processing performed by the inkjet printing apparatus 100 for aligning the detection portion of the detector 107 with target ejection ports of the print head 102 at the location where the detection portion can detect ink ejection for the target ejection ports in the print head 102.

The correction value detection processing is the processing for obtaining a correction value for the positional relationship between the detector 107 and target ejection ports, and employing the correction value to adjust the position of the detector 107, so that when detection for the ink ejection state is performed, ink droplets ejected from the target ejection ports will cross the light axis of the detector 107. The correction value detection processing need not be frequently performed, but at least should be performed when the inkjet printing apparatus is initially installed, or when the print head 102 is replaced with a new one. In this embodiment, the X-directional range where the detector 107 can detect passage of the ink droplet is a small area having only the length of about 1.5 mm around the reference position. Therefore, correction of alignment for the print head 102 with the detector 107 is required. If correction of alignment for the print head 102 with the detector 107 is not performed, the position of the detector 107 is shifted from the position of the target ejection ports, and ink droplets ejected from the ejection ports do not cross the vicinity of the center of the detection area of the detector 107. As a result, the detection results obtained by the detector 107 may be unstable.

In this embodiment, since correction of alignment is performed for the detector 107 and ejection ports, an appropriate distance the detector 107 should move from the initial position is determined, so that ink droplets ejected from the ejection ports will cross the center of the detection area of the detector 107. As a result, the positional information is obtained in advance about the location of the detector 107 corresponding to the ejection ports. In this embodiment, the CPU 404 serves as positional information acquisition means that obtains positional information, in advance, as for the location corresponding to the target ejection ports.

In the correction value detection processing, the carriage 101 is moved to the vicinity of the position (target position) corresponding to the first ejection port array 202 to be examined (S501). At this time, fine adjustment is not required for the position of the detector 107 and the position of the target ejection ports, and approximate alignment is performed.

In a case wherein the first ejection port array 202 to be examined is, for example, a cyan EVEN array, the target carriage position corresponding to the cyan EVEN array is obtained from the memory 410, and the carriage 101 is moved by driving of the carriage motor 104 near the target position. A sensor (not shown) for reading a linear encoder is provided for the carriage 101, and a linear encoder value is counted while the carriage 101 is moved. As a result, the position information in accordance with the movement of the carriage 101 can be obtained. When the carriage 101 is stopped near the target position, accurate positional information is obtained based on the value obtained by the sensor, and is stored in the memory 410 (S502). At this time, the carriage 101 is merely moved to an approximate position near the target position, and is not moved to the accurate position where the detector 107 can examine the ejection state for the target ejection ports.

When the carriage 101 was moved to an approximate position near the target position and has been stopped, the detector 107 is moved by driving the stage drive motor 307 to the first inspection position, which is one of positions corresponding to the target ejection ports (S503). At this time, accurate aligning of the detection portion of the detector 107 with the target ejection ports is performed by moving the detector 107. In the correction value detection operation, the carriage 101 is halted near the target position, and then, only the detector 107 is moved, accurately and by small distances, to a plurality of positions corresponding to the target ejection ports. At this time, since the CPU 404 permits the motor driver 411 to drive the stage drive motor 307, the moving of the detector 107 is controlled, so that the inspection position of the detector 107 corresponds to the position of the ejection ports to be examined. In this embodiment, the CPU 404 serves as inspection position moving control means that controls the movement of the detector 107.

The moving range of the detector 107 for inspection is ±2.0 mm around the reference position (the target inspection position on the design level), and the moving pitch is 0.2 mm. Here, a (−) sign represents a direction from the reference position to the recovery unit 109 (the negative direction along the X axis), and a (+) sign represents a direction from the reference position to the platen 106 (the positive direction along the X axis). The first inspection position is at a distance of −2.0 mm from the reference position, and examination is performed while the detector 107 is being moved by a distance of 0.2 mm toward the platen 106.

When approximate adjustment is to be performed for the position of the detector 107 and the target ejection ports, and thereafter, fine, accurate adjustment is to be performed for these positions, first, the threaded shaft 306 connected to the drive shaft of the stage drive motor 307 is rotated and moves the table 305, screwed with the threaded shaft 306, so that moving of the detector 107 is performed. Therefore, a small movement of the detector 107 can be controlled, and fine adjustment for the position of the detector 107 is enabled. Further, a movement of the detector 107 can be accurately controlled. Moreover, only a small load is imposed to move the detector 107, and the detector 107 can be easily and precisely halted at a predetermined position. In addition, within only a short period of time, the detector 107 can be accurately moved to a predetermined position, and the period required for examining the ink ejection state can be reduced.

When the detector 107 is moved to and halted at the inspection position that corresponds to the target ejection ports, the print head 102 performs the ejection operation via predetermined ejection ports arranged in an ejection port array to be examined. Thus, the detector 107 is employed for examining whether ink droplet has been detected (S504). In this embodiment, 20 ejection ports from either end of the target ejection port array are employed to perform ink ejection, i.e., a total of 40 ejection ports are employed for examination. First, ink is ejected sequentially from 20 ejection ports close to the LED 301 of the detector 107. The CPU 404 employs, as a trigger, the timing at which ink is ejected from the ejection port, and stores, in the memory 410, a detection signal obtained by the detector 107. Thus, the ink ejection state for each ejection port of the ejection port array close to the LED 301 is examined.

Similarly, ink is ejected sequentially from 20 ejection ports close to the photodiode 302, and a detection signal obtained by the detector 107 for each ejection port is stored in the memory 410. When ejection of ink from all of the ejection ports at either end of the ejection port array 202 is completed, the detection results stored in the memory 410 are employed to determine the ink ejection state at the inspection position. In a case wherein ejection of ink has been detected for 15 or more ejection ports out of 20 ejection ports at either end of the target ejection port array, it is ascertained that the pertinent inspection position is a detection enabled position. In a case wherein the number of ejection ports, for which ejection of ink is detected, is smaller than 15, it is ascertained that the pertinent inspection position is a detection disabled position. This determination process is performed separately for the LED 301 end of the ejection port array and the photodiode 302 end.

When the ink ejection state for each ejection port has been examined, and when there is still a portion that is not yet examined by the detector 107 at the inspection position, the detector 107 is moved from the previous inspection position by distance 0.2 mm toward the platen 106, and examination of ink ejection is performed in the same manner.

In this embodiment, a plurality of ejection port arrays 202 are examined to determine whether ejection of ink is performed normally. In a case wherein a plurality of ejection port arrays 202 are formed for the print head 102, a reference detection position is set for each of the ejection port arrays 202, and aligning of the detector 107 is performed for each of the ejection port arrays 202.

In this embodiment, the X directional detection range of the detector 107 for detecting passage of ink is set to an area having a length of about 1.5 mm. In a case wherein this detector 107 is employed, and is gradually moved from the platen 106 toward the target ejection port array to detect the ink ejection state, ejection of ink droplets may not be detected, depending on the first inspection position that is set for the detector 107. For example, when the first inspection position is set to a position apart from the reference position at distance of 2.0 mm toward the platen 106, the detector 107 can not detect ejection of ink droplets. Specifically, at the end of the ejection port array either close to the LED 301 or close to the photodiode 302, the number of ejection ports, for which ejection of ink has been detected at the inspection position, is zero out of twenty ejection ports, and therefore, the pertinent inspection position is regarded as a detection disabled position. When the detector 107 is gradually moved to the ejection port array from such a position apart at a distance, and reaches a position near the center of the ejection port array, ejection of ink can be detected. That is, when the detector 107 reaches the vicinity of the reference position, part of ejected ink droplets crosses the detection luminous flux emitted by the detector 107. When the detector 107 is moved closer to the reference position, detection of the ink ejection state is enabled for almost all of the target 20 ejection ports. In this embodiment, in order to determine whether the position where examination is currently being performed is a detection enabled position, a threshold value of 15 is employed for the number of ejection ports, for which the ink ejection state can be obtained. When the number of ejection ports, for which the detector 107 can obtain the ink ejection state, is smaller than 15, it is ascertained that the pertinent position is a detection disabled position. When the number of ejection ports, for which the detector 107 can obtain the ink ejection state, is 15 or greater, it is ascertained that the pertinent position is a detection enabled position. The threshold value of 15 is set in this manner, because the probability that a defective ejection port is included in target ejection ports is taken into account. When it is ascertained, at a specific position of the detector 107, that detection of ink ejection is enabled for the ejection ports both close to the LED 301 and close to the photodiode 302, it represents that the pertinent position of the detector 107 can also be employed to perform examination for other ejection ports of the target ejection port array. This examination operation is performed at the individual inspection positions that are set for each ejection port array, and the results obtained by performing examination at the individual inspection positions are stored in the memory 410.

When examination for all of the inspection positions has been completed (S505), a correction value is determined by employing the examination results obtained at the inspection positions, which are set for the respective ejection port arrays (S506). Specifically, the positions of the detector 107 in a movable range are examined at the interval of 0.2 mm, and among all of the positions, a plurality of continuous positions are regarded as detection enabled positions. Further, the center position of the range is calculated for the LED 301 side and for the photodiode 302 side.

In this embodiment, the detection enabled position is in a range of about ±0.6 mm around the reference position of the detector 107. The center position of the detector 107 may be shifted in the positive direction, or in the negative direction due to the positional accuracy or the dimensional tolerances of the carriage 101. Further, there is also a probability that, because of the inclination of the print head 102 relative to the detector 107 (inclination on the XY plane), a shift occurs between the detection enabled position range, provided for the ejection ports on the LED 301 side, and the detection enabled position range, provided for the ejection ports on the photodiode 302 side. Therefore, in this embodiment, when the center position on the LED 301 side and the center position on the photodiode 302 side are obtained, the intermediate position between the center position on the LED 301 side and the center position of the photodiode 302 side is obtained. Thereafter, these center positions and the intermediate position, a shift from the reference position of the detector 107 and a shift from the target stop position of the carriage 101 are employed to obtain a correction value for aligning the print head 102 with the detector 107.

For example, in a case wherein a distance of −0.1 mm is a difference in the X direction between the target stop position of the carriage 101 and the position where the carriage 101 was actually stopped, and a distance of +0.2 mm is a difference in the X direction between the reference position of the detector 107 and the intermediate position obtained by calculation, the relative value of those is +0.3 mm. Therefore, a correction value of +0.3 mm is stored in the memory 410.

When a specific ejection port array 202 has been completed, and there is still an unexamined ejection port array 202 (S507), the carriage 101 is moved to the vicinity of the target position corresponding to the unexamined ejection port array 202, and information for the carriage position at this time is obtained. Thereafter, the detector 107 is moved to sequentially perform examination of ink ejection, and the correction value is determined. In this manner, detection of the ink ejection state is performed for all of the ejection port arrays, and the correction value detection operation is terminated.

The correction value detection operation for a plurality of ejection port arrays 202 have been described for this embodiment. However, the correction value detection operation need not be performed for all of the ejection port arrays 202. For example, when variation in the ejection port arrays 202 included in each print head 102 is at a permissible level, only one of the ejection port arrays 202 for one print head 102 may be employed for detection. For a printing apparatus on which a plurality of the print heads 102 are mounted, detection of the ink ejection state may be performed for each of the print heads 102 to determine a correction value for a representative ejection port array 202 of the print head 102.

(Ejection State Examination)

Figure 6:
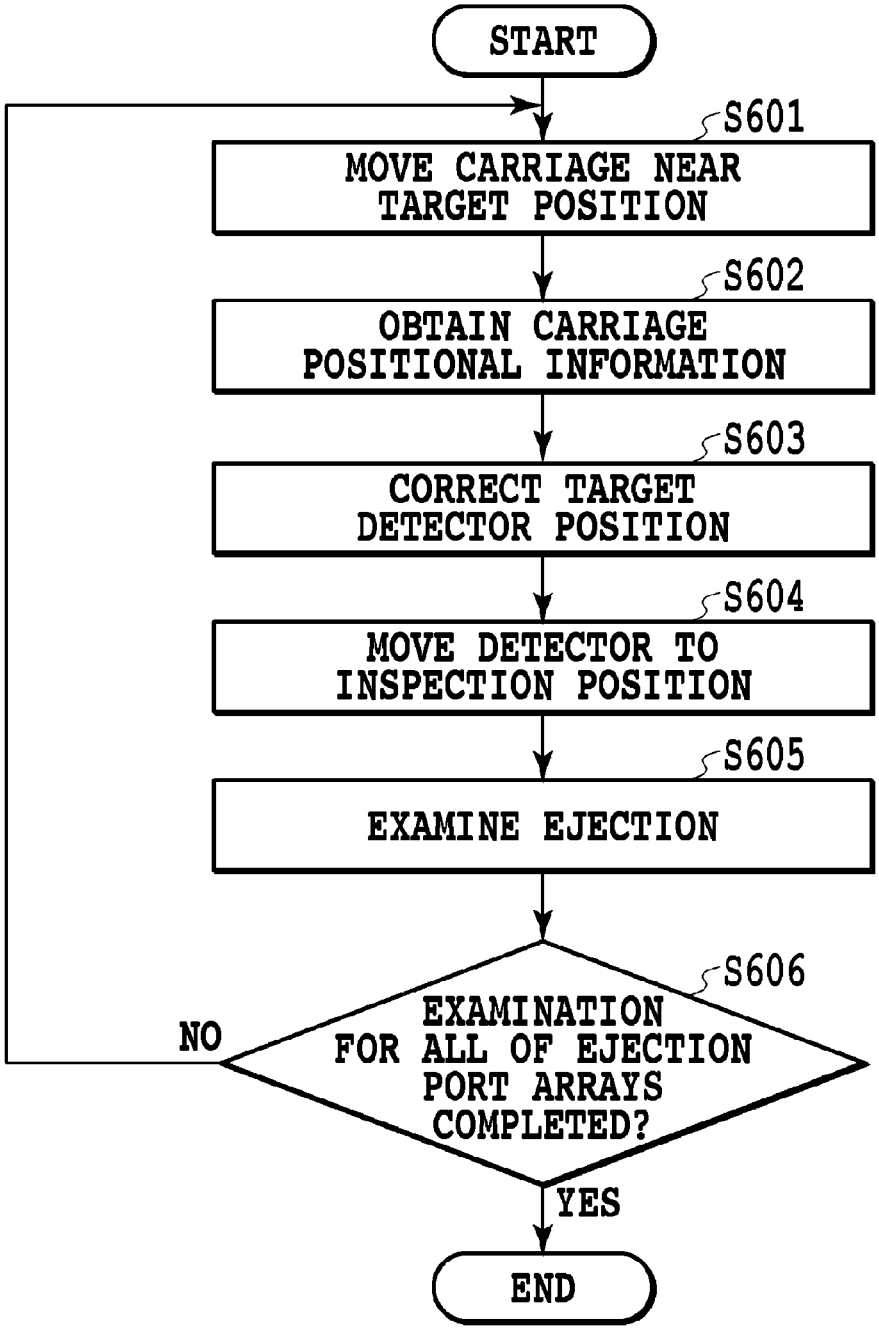
FIG. 6 is a flowchart showing the control processing performed by the inkjet printing apparatus in FIG. 1 to examine the ejection states of the ejection ports.

An ejection state examination method for an ejection port will now be described by employing a flowchart in FIG. 6. The processing for detecting the ink ejection state is performed generally at the following occasion: when the printing apparatus is initially installed; immediately after the print head 102 is exchanged to a new one; after a predetermined number of pages has been printed; after a predetermined number of ink droplets have been ejected; or immediately after the clearing operation for the print head 102 has been performed. First, the carriage 101 is moved to the target carriage stop position that corresponds to the first ejection port array 202 to be examined (S601). When the carriage 101 is stopped in the vicinity of the target position, the value obtained from the linear encoder is employed to obtain the correct positional information of the carriage 101 (S602). At this time, the detector 107 need not be correctly located at the target position, and is approximately located at the target position. That is, the carriage 101 is moved to the vicinity of the target position, so that the target ejection ports are positioned at least in the movable range of the detector 107 where the ink ejection state for the pertinent ejection ports can be examined. In other words, the carriage 101 is moved to the vicinity of the target position, so that ink ejected from the target ejection ports passes through the movable area of the detector 107.

When the accurate positional information of the carriage 101 is obtained, the correction value detection process is performed, and the position of the detector 107 is corrected to the exact target position based on a correction value that is stored in the memory 410(S603). For example, assume that, based on the value obtained by the linear encoder, the carriage 101 is actually stopped at a position at a distance of +0.2 mm from the target position, and a correction value of +0.3 mm is stored in the memory 410. At this time, the target position of the detector 107 is corrected by a distance of +0.5 mm from the reference position in the X direction. In a case wherein the carriage 101 is stopped at the position at a distance of −0.5 mm from the target position, the target position of the detector 107 is corrected by a distance of −0.2 mm from the reference position.

When the target position of the detector 107 has been corrected, the stage drive motor 307 is driven, and moves the detector 107 based on this correction information (S604). Before the ejection state detection processing is initiated, the detector 107 is located at the reference position, or the position obtained by applying the correction value, and therefore, the distance the detector 107 actually moves is only a distance equivalent to a correction value. In this example, the detector 107 is moved even in a case wherein the correction value is −0.2 mm. However, when a correction value is a very small value, such as a predetermined value or smaller, with respect to the detection enabled range of the detector 107, the ejection operation may be begun, without moving the detector 107. As a result, the period required for moving the detector 107 can be reduced.

As described above, in this embodiment, the detector 107 is moved so that the inspection position for the detector 107 corresponds to the position of the target ejection ports that are obtained in advance. At this time, the CPU 404 controls the movement of the inspection position for the detector 107.

When the detector 107 is moved to the target position, ejection of ink droplets is performed from the ejection ports of the ejection port array to be examined. In this case, ejection is performed sequentially from the individual ejection ports until ejection from all of the ejection ports of the ejection port array is completed. By performing ejection of ink, the detector 107 determines, for each ejection port, whether an ink droplet passed or not (S605). In this embodiment, one ejection port array 202 includes 640 ejection ports, which are to be examined by moving the detector 107 at one time. In the ink ejection detection processing, when an ink droplet was ejected from an ejection port and passed through, the detector 107 detects passage of the ink droplet and outputs a detection signal. Therefore, it is ascertained that the ejection port is a normal ejection port. However, in a case wherein, although the ejection operation is performed, a detection signal indicating that ejection of ink is detected is not output, it is ascertained that the pertinent ejection port is an ejection failure. An ejection failure in this case includes not only the state wherein ink around the ejection port has solidified and caused clogging the ejection port to prevent ink from being ejected through the ejection port, but also the state wherein the accuracy for landing of ejected ink is lowered, and ink does not land at a predetermined position. These states may occur when ink mist or dust is attached to the periphery of the ejection port, and adversely affects the ejection of ink to prevent landing of ink to a predetermined position. When the accuracy of landing of ink is lowered, there is a probability that, even when the detector 107 is located at the position corresponding to the target ejection ports, ejected ink may not cross the inspection position of the detector 107. In this case, a detection signal is also not output although the ejection operation is performed, and it is assumed that the pertinent ejection port is an ejection failure. When determination of either normal ink ejection or an ejection failure has been performed for all of 640 ejection ports of the ejection port array 202, the obtained results are stored in the memory 410. The stored data are employed, and an ejection port determined to be a defective ejection port is masked so as not to be used in the printing operation. For performing printing, the other ejection ports are employed to complement the masked ejection port. Therefore, when a defective ejection port is found in the print head 102, printing of high quality without white stripes or uneven colors can be maintained.

When examination for the ink ejection state has been completed for 640 ejection ports of the ejection port array 202, a check is performed to determine whether there is still another ejection port array 202, for which the ejection state is to be examined (S606). When there is another ejection port array 202 for which the ink ejection state is to be examined, the carriage 101 is moved to the vicinity of the target position that corresponds to the ejection port array to be examined. Then, the carriage positional information is obtained in the same manner as described above, the position of the detector 107 is corrected to the exact target position, and thereafter, the detector 107 is moved accurately to the target position. When the detector 107 is moved exactly to the target position, the detector 107 sequentially detects the ink ejection state for the individual ejection ports of the target ejection port array. In this manner, the ink ejection state is detected for the remaining ejection port array, and thus, examination is performed for the ink ejection states of all of the ejection port arrays included in the print head 102.

As described above, in this embodiment, when aligning is performed for the detector 107 with the ejection ports to be examined, first, the carriage 101 on which the print head 102 including ejection ports is mounted is moved toward the detector 107. Since approximate positioning is performed in this processing, the carriage 101 need only be moved to set the detector 107 in the vicinity of the target ejection ports. Following this, the detector 107 is moved across the stage 108 to perform accurate alignment for the detector 107 with the ejection ports to be examined. At this time, the detector 107 is moved across the stage 108 finely and is located exactly at the position corresponding to the target ejection ports. Since alignment for the detector 107 with the target ejection ports is performed by moving the carriage 101 and the detector 107 in this manner, the weights of the portions that are required to move for final, fine positioning adjustment can be reduced.

For an inkjet printing apparatus that handles large size printing media, especially, a comparatively large carriage is employed, and may have a large weight. In order to stop such a heavy carriage at the target position accurately, a large load is required to move the carriage, and it is also difficult to stop the carriage at a predetermined position accurately. Further, in a case wherein the heavy carriage is to be moved accurately and fast to a predetermined position, the load imposed for moving the carriage is increased, and it is more difficult to stop the carriage exactly at a predetermined position. In order to satisfy such a demand, an available method is the increase of the size of a motor that is driven to move a heavy carriage. However, when the motor size is increased, accordingly, the cost of the inkjet printing apparatus would be raised.

Furthermore, in a case wherein the carriage is stopped at a position apart from the target position at a distance over a tolerance, conventionally, the carriage is moved again to return to the target position. At this time, since it is difficult to move the carriage by small distances by the unit of 100 μm, the carriage 101 must be temporarily retreated at a different position, and be restarted to move to the target position. However, when this operation is required each time the target ejection port array is changed, a period required for the ejection state detection operation is accordingly extended.

Whereas, according to the present invention, only a small load is imposed to move the stage 108 on which the detector 107 is mounted, and further, a load imposed to move the detector 107 is also reduced. Therefore, the drive force of the stepping motor to move the detector 107 can be reduced, and the displacement due to the rotation of the stepping motor can be accurately adjusted. Therefore, the alignment process using the detector 107 can be easily performed accurately. Further, since within a short period of time, the detector 107 can be moved exactly to a predetermined position, a period required for examining the ink ejection state can be reduced. Furthermore, since the size of the motor can be reduced, the manufacturing cost of the inkjet printing apparatus can be lowered.

In this embodiment, the threaded shaft 306 and the stepping motor have been employed together for the structure of the stage 108 on which the detector 107 is mounted; however, the present invention is not limited to this structure. A DC motor may be employed, and in this case, an encoder for detecting the rotation angle of the motor can be employed to provide the same effects as in the embodiment. Furthermore, the threaded shaft 306 screwed with the stage 108 has been employed as a mechanism that moves the detector 107; however, the present invention is not limited to this mechanism, and the structure that employs a belt to move the stage may also be employed. So long as the detector 107 is accurately moved, other structures may also be available, and an arbitrary structure can be selected while taking into account the target values for all of the accuracy, the speed and the cost.

Second Embodiment

A second embodiment of the present invention will now be described. No explanation will be given for the same portions as those for the first embodiment, and only a difference from the first embodiment will be described.

For a print head 102 of the second embodiment, a plurality of ejection ports are arranged to form a comparatively long ejection port array to be examined. In a case wherein the print head 102 is extended in the Y direction shown in FIG. 2 or 3, or wherein a plurality of print heads 102 are arranged in the Y direction, the area wherein ink is to be ejected from the print head 102 may be expanded. In such a case, a correction value tends to differ at both ends in the area where ink is to be ejected. Further, because of an installation error of the print head 102, there is a probability that the print head 102 is mounted with an inclination of, with respect to the Y axis, the direction in which the ejection port array is extended. When the print head 102 formed in an elongated shape is installed with being slightly inclined, a correction value becomes greatly different between both ends of the ejection port array. In a case wherein the correction value differs between the two ends in the ink ejection area, it is difficult that examination of the ink ejection state is performed by adjusting the position of the detector 107 only one time.

In a case wherein, for example, an inclination of one degree on the XY plane is present between the print head 102 having a length of two inches (50.8 mm) and a detector 107, and the light axis extends along Y direction, the ejection ports are shifted by distance of about 0.9 mm in the X direction between the end close to an LED 301 and the end close to a photodiode 302. For performing detection of the ink ejection states for the two ends of the ejection port array, the detector 107 must be moved at a distance of 0.9 mm after the examination of the ink ejection state has been performed for the ejection ports at the LED 301 end and before the examination is to be performed for the ejection ports at the photodiode 302 end. On the other hand, in a case wherein the detection enabled range of the detector 107 is about 1.0 mm, the most of the movable range of the detector 107 is employed to examine one ejection port array. Therefore, in the processing for moving the carriage 101 to the approximate position near the detector 107, it is required that the carriage 101 be stopped exactly at the detection position for the detector 107. That is, the detector 107 must be moved with little margin that is employed to adjust the positions of the target ejection ports and the detection portion of the detector 107.

As a measure for resolving this problem, the following method can be employed. The ejection port array 202 is divided into a plurality of areas, and the target position of the carriage 101 is designated for each area. With this arrangement, when detection of the ejection state for one area is completed, the carriage 101 is moved again to the target position for the succeeding area. However, according to this method whereby the carriage is moved each time, the number of times to detect a correction value would be increased, and each time, the ejection detection process must be performed from the beginning, and a total period required for the detection of the ejection state would be increased.

According to the inkjet printing apparatus of the second embodiment, for the print head 102 mounted with an inclination, the ink ejection state for target ejection ports is performed in the following manner. The length of the print head 102 of the first embodiment is one inch, while the length of the print head 102 of this embodiment is two inches. Further, the distance between the LED 301 and the photodiode 302 of the detector 107 is provided in consonance with the size of the print head 102, which is two inch long.

In the correction value determination operation for the second embodiment, first, a correction value is calculated for the center points of the detection enabled positions for a plurality of ejection ports at the LED 301 end of the ejection port array. A correction value is also calculated for the center points of the detection enabled positions for a plurality of ejection ports at the photodiode 302 end. The second embodiment differs from the first embodiment in this process, i.e., in the second embodiment, different target positions are designated for the ejection ports of the ejection port array at the LED 301 end and for the ejection ports at the photodiode 302 end.

In a case wherein, for example, a relative inclination of one degree is present between the print head 102 of two inch long and the detector 107, and wherein a correction value of −0.4 mm is obtained for the LED 301 side and a correction value of +0.5 mm is obtained for the photodiode 302 side, these two correction values are stored in a memory 410. As a result, positional information is obtained for the individual ejection ports arranged at the two ends of the target ejection port array. In this embodiment, a CPU 404 serves as positional information acquisition means for obtaining positional information for a plurality of ejection ports that are arranged at both ends of a target ejection port array.

Figure 7:
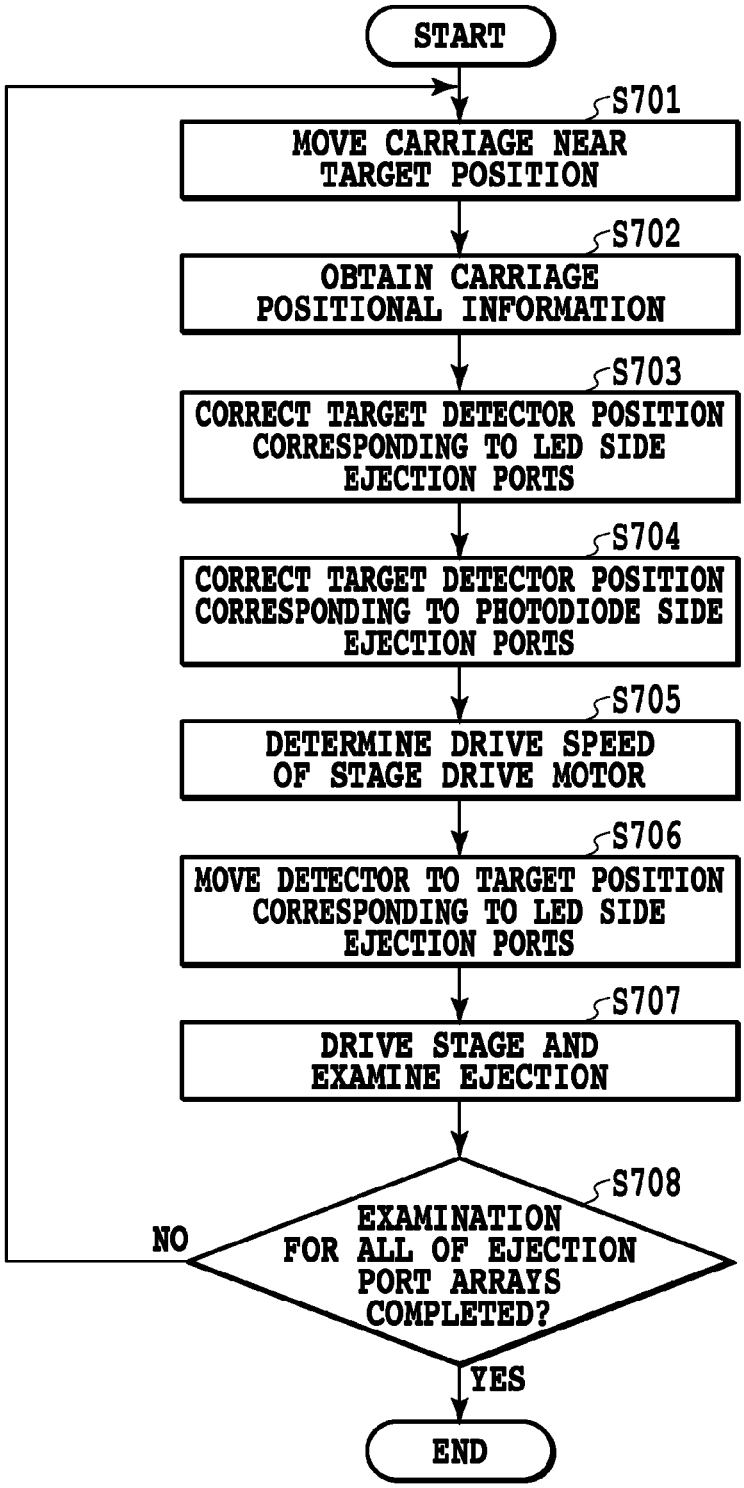
FIG. 7 is a flowchart showing the control processing performed by an inkjet printing apparatus, according to a second embodiment of the present invention, to examine the ejection states of ejection ports.

FIG. 7 is a flowchart showing the ejection state detection operation performed in this embodiment. In the ejection state detection operation, the target position is corrected by employing a correction value that is obtained for alignment with the ejection ports on the LED 301 side (S703). Assuming that the carriage stop position matches the reference position, a correction value for the ejection ports on the LED 301 side indicates a shift of −0.4 mm from the reference position, and therefore, the position of the detector 107 is corrected to a position apart from the reference position at a distance of −0.4 mm.

Subsequently, the position of the detector 107 is corrected by employing a correction value obtained for alignment with the ejection ports on the photodiode side 302 (S704). Since the correction value for the detector 107 with respect to the ejection ports on the photodiode 302 side is +0.5 mm, the target position of the detector 107 is corrected to a position at a distance apart from the reference position.

Following this, the driving speed of a stage drive motor 307 for examining the ejection state is determined. A fixed period of time for performing detection of the ink ejection state is provided for the individual ejection ports of one ejection port array 202. Therefore, the moving speed of the stage 108 is calculated by dividing a difference of 0.9 mm, between the target detector position for the ejection ports on the LED 301 side and the target detector position for the ejection ports on the photodiode 302 side, by a total length of detection periods required for the plurality of ejection ports. The obtained moving speed of the stage 108 is employed to determine the driving speed of the stage drive motor 307 (S705).

The detector 107 is thereafter moved to the target position that has been corrected in consonance with the ejection ports on the LED 301 side (S706). When the detector 107 has reached the target position that corresponds to the ejection ports on the LED 301 side, ink is ejected from the ejection ports to start examination of the ink ejection state. At this time, in the inkjet printing apparatus, while examination of the ink ejection state is being performed for the individual ejection ports, the stage drive motor 307 is driven at the driving speed thus determined (S707). Therefore, the detector 107 is moved toward the target position that corresponds to the ejection ports on the photodiode 302 side. That is, while examination of the ink ejection state is being performed, the detector 107 is moved. Thereafter, when examination for the ink ejection state is to be performed for the last ejection port on the photodiode 302 side, the stage 108 also reaches the target ejection port position on the photodiode 302 side. In other words, when the detector 107 is being moved from a position that corresponds to a plurality of ejection ports arranged at one end of the target ejection port array 202 to a position that corresponds to a plurality of ejection ports arranged at the other end, the detector 107 sequentially detects the ink ejection state for the target ejection port array 202.

As described above, according to the arrangement of this embodiment, the ink ejection state for the ejection port array 202 can be examined, while the position of the detector 107 relative to the position of the print head 102 is changed during the examination operation. Therefore, since the carriage need not be moved to the positions that correspond to the two ends of the ejection port array in the print head 102, a period required for detection of the ink ejection state for all of the ejection ports can be reduced.

According to the conventional arrangement, since a large load is imposed to move the carriage 101, it is difficult that the carriage 101 is moved at a constant speed and by a very small distance. Therefore, in a case wherein detection of the ink ejection state is required for an ejection port array having a great length from end to end, the following procedures must be performed; first, the ink ejection state for ejection ports at one end of the ejection port array is examined, and thereafter, the carriage 101 is temporarily moved to a different location, and then, moved to the target position that corresponds to the ejection ports on the other end. In this case, each time the carriage 101 is moved, the examination process must be halted, and an extended period of time is required for performing detection of all of the ejection ports.

According to this embodiment, since the detector 107 can be accurately moved, the gradual positional change for the detector 107 is enabled during the examination operation. Therefore, the inclination of the print head 102 or the detector 107 can be flexibly coped with.

In this embodiment, an explanation has been given for the method whereby, when the target portion is changed from the LED 301 side to the photodiode 302 side of the ejection port array 202, the stage drive motor 307 is consecutively operated to move the detector 107. However, the present invention is not limited to this method. The same effects can be obtained by using a method whereby the detector 107 is moved step by step in consonance with the target ejection ports, for which the ink ejection state is to be examined. Unlike in the case wherein the alignment is performed by using only the carriage 101, micro-movement of the stage 108 is also enabled by this method, and moving of the stage 108 at a long distance is not required, so that a period required for the ejection examination is not so much increased.

Furthermore, the number of times in this case for moving the detector 107 step by step may be changed in accordance with the inclination of the print head 102 relative to the detector 107. When the relative inclination is great, the number of ejection ports to be examined by the detector 107 at one target position is reduced, and the number of times for moving the detector 107 is increased. In a case wherein the inclination of the print head 102 relative to the detector 107 is small, the number of ejection ports to be examined by the detector 107 at one target position is increased, while the number of times for moving the detector 107 is reduced. When the number of times for moving the detector 107 is changed in accordance with the inclination of the print head 102 relative to the detector 107, a period required for moving the detector 107 can be reduced. In a period during which the detector 107 is being moved, ejection of ink may be halted; however, in order to reduce a period required for examination, ejection of ink for examination may also be performed during moving of the detector 107.

Third Embodiment

A third embodiment of the present invention will now be described. No explanation will be given for the same portions as those for the first and second embodiment, and only a different portion will be described.

A difference of the third embodiment from the first and second embodiments is that, for two ejection port arrays, a first target position is designated with respect to one ejection port array, and then, alignment of a detector 107 with ejection ports in other ejection port array to be examined is performed by performing positional correction based on the target position. In the third embodiment, a plurality of target ejection port arrays, each consisting of a plurality of target ejection ports, are formed in a print head 102.

Figure 8:
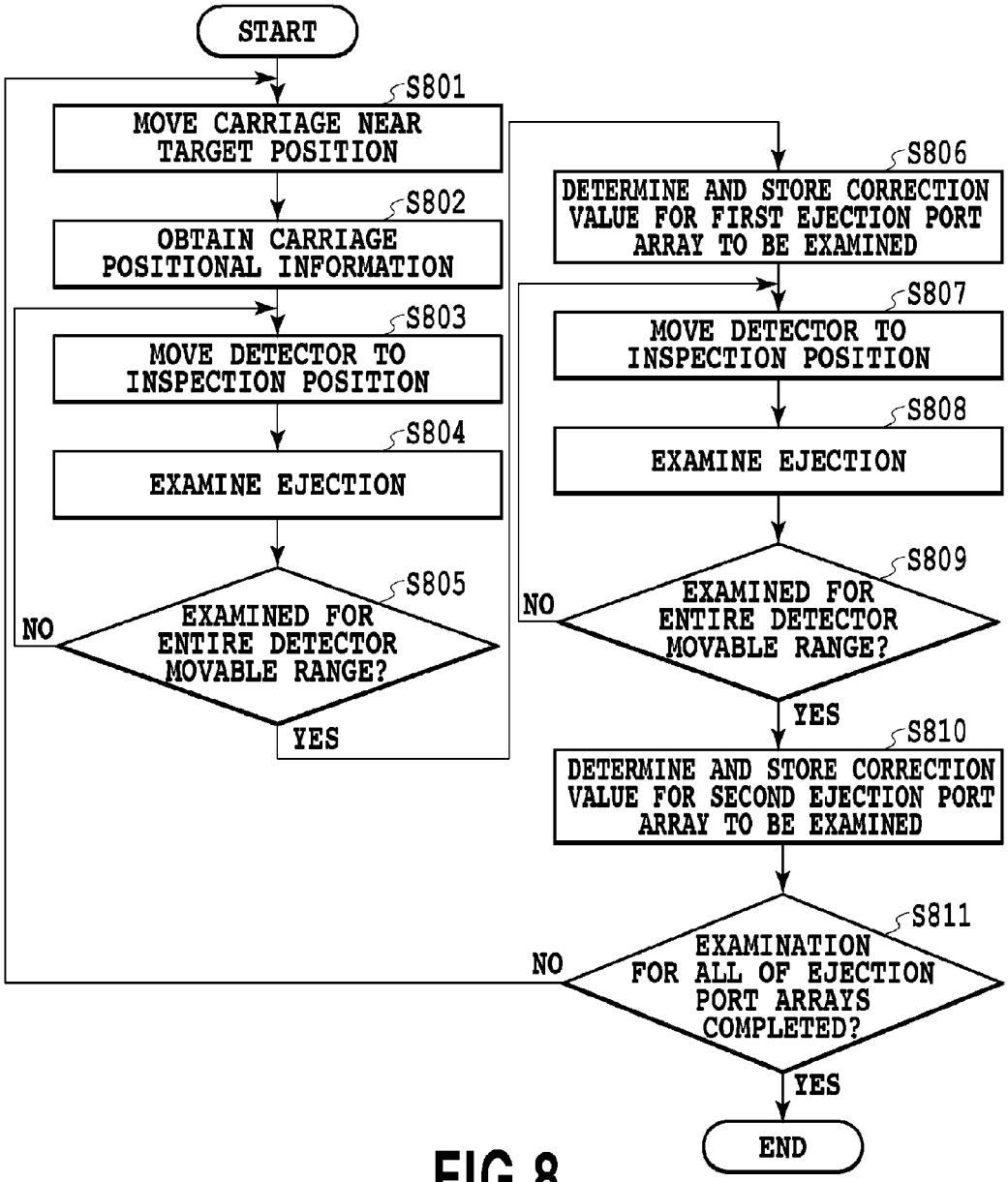
FIG. 8 is a flowchart showing the control processing performed by an inkjet printing apparatus, according to a third embodiment of the present invention, to align the detection portion of a detector with detection target ejection ports of a print head.
Figure 9:
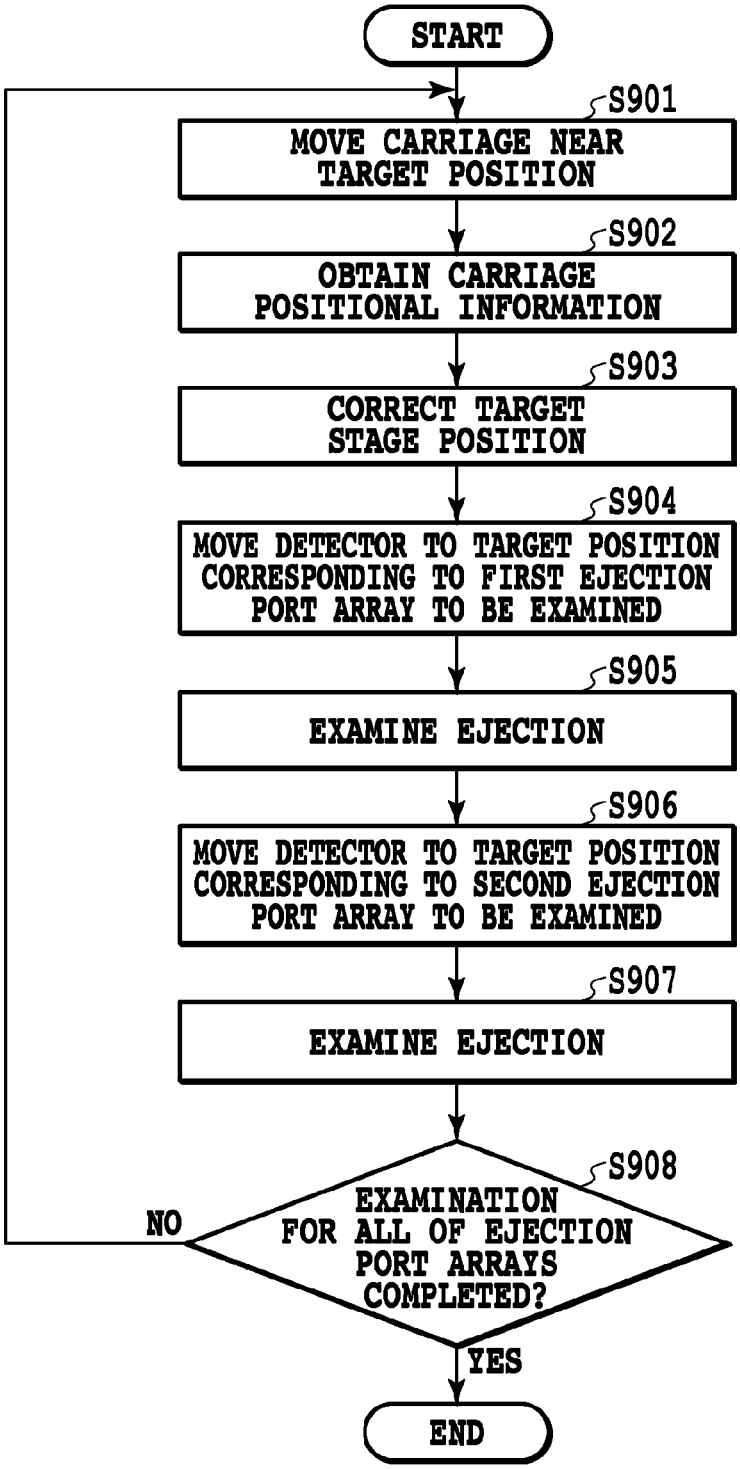
FIG. 9 is a flowchart showing the control processing performed by the inkjet printing apparatus, according to the third embodiment of the present invention, to examine the ejection states of the ejection ports.

FIG. 8 is a flowchart showing a correction value detection operation performed for this embodiment, and FIG. 9 is a flowchart showing an ejection state detection operation. In the correction value detection operation, first, at a step of moving the carriage 101 (S801), a target position for the carriage 101 is designated at the center location between a first ejection port array to be examined and a second ejection port array to be examined. This target position of the carriage 101 is so set that the target position matches the center position in the movable range of the detector 107. The second ejection port array to be examined indicates an ejection port array 202 that is paired with the first ejection port array to be examined. Through this process, the positional information is obtained for the individual target ejection port arrays to be examined.

In this embodiment, for example, when the first ejection port array to be examined is a cyan EVEN array, the second ejection port array to be examined is a cyan ODD array. That is, the two adjacent ejection port arrays 202 of one print head 102 become the first ejection port array and the second ejection port array to be examined. Further, in this embodiment, the two ejection port arrays 202 are positioned close to each other, at a distance of 0.25 mm along the X axis, which is smaller than the movable range of the detector 107. Therefore, examination for both the first and second ejection port arrays can be performed only by moving the detector 107.

Next, a correction value for the individual target ejection port arrays from the target position to be examined is calculated. When the carriage 101 is stopped near the target position between the two ejection port arrays, the detector 107 is moved to the inspection position that corresponds to the first ejection port array (S803). When the detector 107 is located at the inspection position, examination for ink ejection is begun (S804). In a case wherein a moving range of ±2.0 mm around the reference position is set for the detector 107 to examine the ejection state for the first ejection port array, examination is started at the position a distance of −2.0 mm apart from the reference position, and the inspection position is moved at the pitches of 0.2 mm.

When examination for the first ejection port array has been completed, a correction value for alignment with the first ejection port array is determined, and is stored in a memory 410 (S806).

Following this, the detector 107 is moved to the position that corresponds to the second ejection port array (S807), and the ink ejection state is examined in the same manner (S808). When the ink ejection state for the second ejection port array has been examined, a correction value for alignment with the second ejection port array is determined, and stored in the memory 410 (S810).

Based on the obtained correction values, the detector 107 is moved to the positions that correspond to the first and second ejection port arrays, and detects the ink ejection states of these ejection port arrays. For the ejection state detection operation, the carriage 101 is moved to, and halted in the vicinity of the target position designated between the first and second ejection port arrays (S901). After the carriage 101 is stopped, the carriage stop position is accurately obtained by a linear encoder, and the target position of the detector 107 is corrected (S903). Thereafter, the detector 107 is moved to the corrected target position in order to examine the ink ejection state for the first ejection port array. When the detector 107 is set at the corrected target position, the ink ejection state is examined for the ejection ports of the first ejection port array (S905). When the examination has been completed, the carriage 101 remains at the same position, and only the detector 107 is moved to the target position that is corrected for the second ejection port array. When the detector 107 is set at the target position that is corrected for the second ejection port array, the ink ejection state is examined for the ejection ports of the second ejection port array (S907). When the ink ejection state has been examined for both the first and second ejection port arrays, the carriage 101 is moved to the target position that corresponds to the succeeding ejection port arrays to be examined. When the carriage 101 reaches the next target position, the ejection state is examined in the same manner for the first and second ejection port arrays. The above described operation is repeated to detect the ink ejection state for all of the target ejection port arrays (S908). As described above, in this embodiment, moving of the detector 107 to the inspection position is controlled, so that the inspection position corresponds to the location obtained in advance for the ejection port arrays to be examined.

The ejection state detection operation for this embodiment has been explained. As described above, in this embodiment, the ejection states for the first and second ejection port arrays are examined simply by changing the position of the detector 107 at the same carriage stop position. Conventionally, the carriage 101 is moved each time in a case wherein the ejection port arrays are switched between the EVEN array and the ODD array provided even at the small pitch. Therefore, moving of the carriage is required each time a target ejection port array is changed, and accordingly, a period for detection of the ink ejection state is extended. On the contrary, in this embodiment, when examination is to be performed for the ejection port arrays 202, such as the EVEN array and the ODD array, arranged at a small pitch relative to the moving range of the detector 107, only the detector 107 is moved, while the position of the carriage 101 is unchanged. As a result, compared with the system that moves the carriage each time an ejection port array is changed for examination, the number of steps for moving the carriage can be reduced. Furthermore, a period required for examination of the ink ejection state for all of the ejection ports of the print head 102 can be reduced, and the examination of the ink ejection state can be performed quickly.

According to this embodiment, moving of the carriage 101 is not required, and only the detector 107 is moved to perform examination for the two ejection port arrays. In a case wherein three or more ejection port arrays are covered in the movable range of the detector 107, examination of these three or more ejection port arrays can be performed only by moving the detector 107.

Furthermore, in the correction value detection operation for this embodiment, a correction value for alignment has been obtained respectively for the first ejection port array and the second ejection port array to be examined. However, in a case that a relative shift between the two ejection port arrays 202 formed in a single print head 102 may be ignored, a correction value may be detected only for one of the ejection port arrays 202. In this case, the positional relationship from the ejection port array 202, for which a correction value has been detected in advance, and the positional relationship may be employed to determine the inspection position employed during the ejection state detection operation.

Fourth Embodiment

A fourth embodiment of the present invention will now be described. No explanation will be given for the same portions as those for the first to third embodiments, and only a difference will be described.

As described for the third embodiment, in a case wherein a plurality of ejection port arrays 202 are arranged in one print head 102, the distance between the ejection port arrays 202 can be reduced. Therefore, when there is an inclination present between the direction in which the ejection port arrays of the print head 102 are arranged and the direction in which the passage area of the detection luminous flux emitted by a detector 107 is extended, the individual ejection port arrays 202 adjacent to each other are partially present within the same detection enabled range of the detector 107. In this embodiment, an explanation will be given for a method for efficiently performing examination under such a condition.

Figure 10:
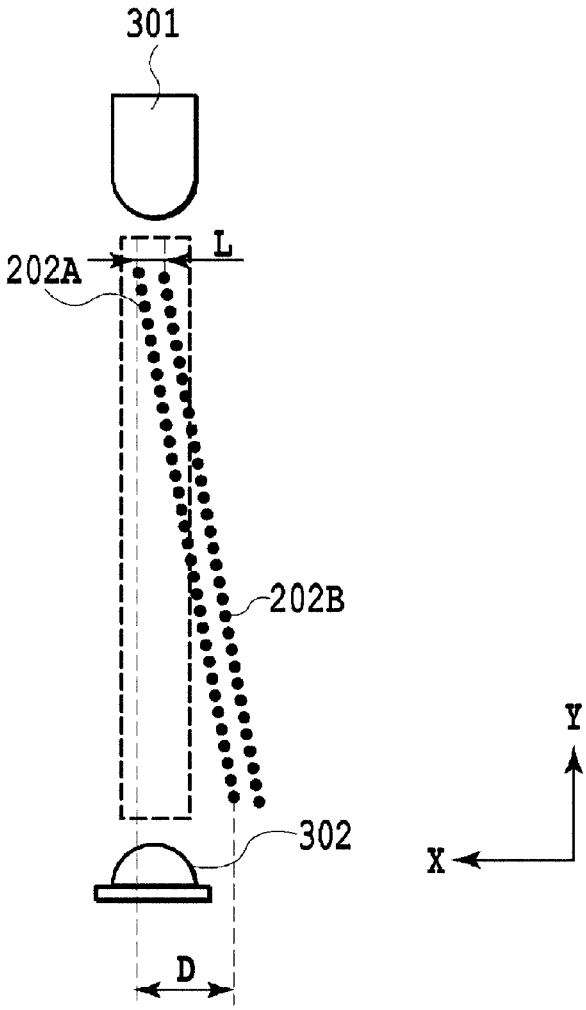
FIG. 10 is a plan view, from the platen side, of a print head for an inkjet printing apparatus, according to a fourth embodiment of the present invention, for explaining the positional relationship of an ejection port array relative to an LED and a photodiode that are employed for examining the ejection states of ejection ports.

FIG. 10 is a diagram showing a relationship between the ejection port arrays 202 described for this embodiment and a detection enabled range for the detector 107. In this example, an ejection port array 202A is employed as an EVEN array, and an ejection port array 202B is employed as an ODD array. The EVEN array 202A and the ODD array 202B are ejection port arrays that have a length of two inches in the Y direction in FIG. 10 and are arranged at an interval of L (0.25 mm) in the X direction. Further, an area enclosed by a broken line in FIG. 10 indicates an area in which the detector 107 can detect ejected ink droplets. In this embodiment, the detection enabled range in the X direction is set as 1.0 mm.

In a case wherein a relative inclination of one degree is present between the print head 201 having a Y-directional length of two inches and the detector 107, and wherein the ejection port at end of LED 301 side of the ejection port arrays 202 matches a light axis, the ejection port at end of a photodiode 302 side are shifted, at a distance D of about 0.9 mm in the X direction, from the ejection port at the end of LED 301 side. Since the detection enabled range of the detector 107 is 1.0 mm, the detection process should be performed by moving the detector 107 in the manner as described in the second embodiment, while taking the positional accuracy of a carriage 101 into the account. However, this embodiment differs from the second embodiment in that the detection process is to be performed by considering the positional relationship between the adjacent ejection port arrays 202A and 202B.

Since the same method as in the second embodiment is employed to obtain an alignment correction value for the LED 301 end and the photodiode 302 end of the ejection port array 202A, no explanation for this method will be given. When the alignment correction value is obtained, the order for the ejection ports to be examined is determined. In the first and second embodiments, since examination is performed for each ejection port array 202, the order in which the ejection ports are arranged in the ejection port array 202 can simply be employed to perform the examination from either the LED 301 end or the photodiode 302 end to other end. In this embodiment, however, the order of performance of examination is determined collectively for both the EVEN ejection port array 202A and the ODD ejection port array 202B. The ejection port of the ejection port array 202A nearest the LED 301 is regarded as the first ejection port to be examined, and the ejection port near the center of the light axis of the detector 107 is determined by referring to a relative inclination value of about one degree between the print head 201 and the detector 107, which is obtained based on the alignment correction value. Since the ejection ports of one ejection port array 202 are arranged at an interval of 1/600 inch (0.04 mm), the N-th ejection port at the LED 301 end of the EVEN ejection port array 201 is shifted in the X direction from the first ejection port thereof, at a distance D of $$0.73\times N(\mu m).$$

Further, the N-th ejection port at the LED 301 end of the ODD ejection port array 202B is shifted in the X direction from the reference position, which is the first ejection port at the LED 301 end of the EVEN ejection port array 202A, at a distance D of $$250+0.73\times(N-1)(\mu m).$$

In this case, a value of 0.73 represents a shift in the X direction between the N-th ejection port and the (N+1)th ejection port when the ejection port arrays have an inclination of one degree with respect to the light axis. That is, in a case wherein the ejection ports of individual ejection port arrays are adjacently arranged at 1/600 pitches in the Y direction, and wherein the ejection port arrays have an inclination of one degree with respect to the light axis, a positional shift of 0.73 is obtained as a distance in the X direction between the ejection ports adjacent in the Y direction. Further, 250 (μm) represents a positional shift in the X direction between the ejection port at the LED 301 end of the EVEN ejection port array 202A and the ejection port at the LED 301 end of the ODD ejection port array 202B.

The above described calculation is performed for the individual ejection ports of the EVEN ejection port array 202A and the ODD ejection port array 202B, and the examination order is determined, beginning from the smallest number for the ejection port (the number provided for the ejection port nearest the center of the light axis). In accordance with the conditions described in this embodiment, the first ejection port at the LED 301 end of the ODD ejection port array 202B is examined following the 341st ejection port at the LED 301 end of the EVEN ejection port array 202A, and thereafter, examination for the ejection ports is performed alternately for the EVEN ejection port array 202A and the ODD ejection port array 202B until the last ejection port at the photodiode 302 end of the EVEN array 202A is reached. When the ejection port numbers for the EVEN ejection port array 202A are allocated as the order for performing examination, the order for performance of examination is allocated for the remaining portion of the ODD ejection port array 202B, according to the order of the arrangement of the ejection ports, beginning from the LED 301 end to the photodiode 302 end.

When the order for examining the ejection ports is determined, the speed of the detector 107 to be moved by the stage drive motor 307 is determined. In the second embodiment, the alignment correction values, obtained for the LED 301 end and the photodiode 302 end of one ejection port array 202, have been employed to determine the speed of the detector 107 to be moved by the stage drive motor 307. In this embodiment, however, since both the EVEN ejection port array 202A and the ODD ejection port array 202B are to be examined at the same time, the moving speed and the moving range of the detector 107, driven by the stage drive motor 307, are determined for a case wherein the detector 107 moves from the first ejection port at the LED 301 end of the EVEN ejection port array 202A to the ejection port at the photodiode 302 end of the ODD ejection port array 202B. In the moving range wherein sequential examination is performed for the EVEN or ODD ejection port array 202, there is a section in the range where examination is performed alternately for the EVEN and ODD ejection port arrays, and in such a section, twice as many as ink droplets ejected by the ejection ports cross the center of the light axis of the detector 107 per unit time. Therefore, in this section, the moving speed of the detector 107 is reduced by half.

According to the method for performing examination for each ejection port array, in a case wherein the print head 102 and the detector 107 are mounted at an inclination angle, first, the detector 107 is moved in the positive direction along the X axis to examine the ejection state for the EVEN ejection port array 202A. Thereafter, the detector 107 is moved in the opposite direction along the X axis to return the detector 107 to the position corresponding to the ejection ports at the LED 301 end. Then, the detector 107 is moved again in the positive direction along the X axis to perform examination for the ODD ejection port array 202B. That is, the detector 107 must be moved along the X axis in the positive direction, in the opposite direction and in the positive direction. On the other hand, according to the embodiment, the detector 107 can be moved only one time to perform examination for the adjacent ejection port arrays 202A and 202B. Therefore, a period required for examination of the ejection state can be reduced.

In this embodiment, as well as in the second embodiment, not only the detector 107 is continuously moved, but also the ejection ports may be divided into several blocks in accordance with the inclination angle, and based on the blocks, the detector 107 may be gradually moved by the stage drive motor 307.

Fifth Embodiment

A fifth embodiment of the present invention will now be described. No explanation will be given for the same portions as those for the first to the fourth embodiments, and only a difference for this embodiment will be described.

Figure 11:
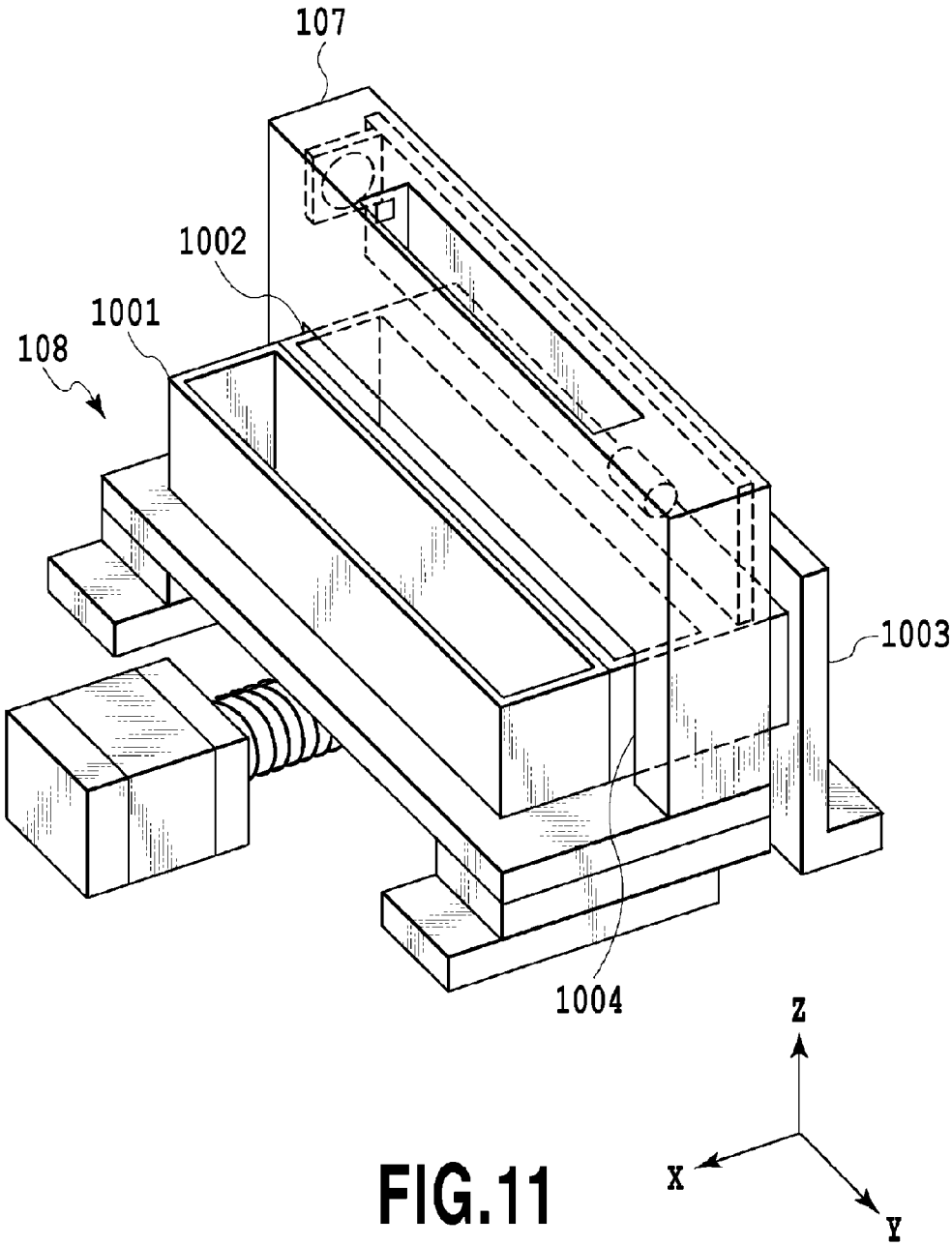
FIG. 11 is a perspective view of a detector, which detects the ink ejection state of a print head employed for an inkjet printing apparatus, according to a fifth embodiment of the present invention, and a stage that moves the detector.

FIG. 11 is a perspective view of the periphery of a detector 107 and a stage 108 according to this embodiment. In this embodiment, a print head 102 can eject several types of ink. Further, a first waste ink reservoir 1001 and a second waste ink reservoir 1002 to collect ink droplets ejected during the ejection state detection operation are provided for the detector 107 and the stage 108 of this embodiment. The two waste ink reservoirs 1001 and 1002 are securely mounted to a side plate 1003. Since the side plate 1003 attached to the body of an inkjet printing apparatus 100 is not moved, the waste ink reservoirs 1001 and 1002 are also not moved, while the detector 107 is moved together with the stage 108. The waste ink reservoirs 1001 and 1002 are positioned in an opening 1004 formed below an LED 301 and a photodiode 302 of the detector 107. The detector 107 is configured so that the detector 107 can be moved an outside of the waste ink reservoirs 1001 and 1002. That is, when the detector 107 is moved, the waste ink reservoirs 1001 and 1002 fixed to the side plate 1003 are passed through the opening 1004. As described above, a plurality of the waste ink reservoirs 1001 and 1002 are arranged in the main scan direction.

The ink detection area of the detector 107 is hollow, and when ink droplets were ejected from the ejection ports and passed through the detection area, the ink droplets have landed on either the waste ink reservoir 1001 or 1002, and are collected. Which of the waste ink reservoir 1001 or 1002 is used to collect the ink droplets is determined based on the positional relationship between the detector 107 and the first and second waste ink reservoirs 1001 and 1002. An ink absorber pad 303 is provided for the first and second waste ink reservoirs 1001 and 1002, and the ink droplets collected in the waste ink reservoir 1001 or 1002 are absorbed by the ink absorber pad 303.

In the ejection state detection operation for this embodiment, the reference position of the detector 107 is changed depending on the ink color for which the ejection state is to be examined. For example, assume that cyan (C), magenta (M), yellow (Y), light cyan (LC) and light magenta (LM) inks are to be collected in the first waste ink reservoir 1001. In this case, the target position of a carriage 101 and the reference position of the detector 107 are determined so as to collect black (K) ink in the second waste ink reservoir 1002. As described above, in this embodiment, the waste ink reservoir 1001 or 1002 to collect ink is changed in accordance with the ink color for which the detector 107 performs detection for the ink ejection state.

For some type of inkjet printing apparatus, in order to quickly fix ink to a printing medium, the individual color inks additionally contains an element that rapidly fixes and dries when cyan ink and black ink, for example, are mixed together. In such a printing apparatus, when ink is ejected to one waste ink reservoir, ink may has solidified and deposited in the waste ink reservoir. When the level of deposited ink is excessively high, the performance of detection of ink droplets using the detector 107 may be adversely affected.

As one method, a deep waste ink reservoir can be prepared for the detection portion of the detector 107 to avoid the detection performance from being adversely affected even when ink has solidified and is deposited. Further, to prevent the individual inks from being mixed, the printing apparatus may include a plurality of detectors 107 that are employed separately for ejection of cyan ink and black ink. However, when this method is employed, the size of the inkjet printing apparatus would be increased, and the manufacturing cost for the apparatus would be raised.

Whereas, according to this embodiment, the target positions of the carriage 101 and the detector 107 are changed in accordance with the ink type and the waste ink reservoir to be employed. Therefore, with a simple structure, a phenomenon can be avoided that ink droplets become solidified in one waste ink reservoir by mixing several inks inside, and the amount of deposited ink is excessively increased.

Sixth Embodiment

A sixth embodiment of the present invention will now be described. No explanation will be given for the same portions as those for the first to the fifth embodiments, and only a difference for this embodiment will be described.

In the sixth embodiment, the ejection state detection operation is performed during the printing operation. For performing the printing operation, ink is ejected by a print head 102 mounted on a carriage 101, while the print head 102 is reciprocally moved across a printing medium in the main scan direction. During the scanning operation, the carriage 101 is passed through an area (inspection means passage area) that corresponds to a range in which the inspection position for the detector 107 can be moved. In this embodiment, the ejection state is examined by using the detector 107 at the timing at which the carriage 101 is passed through the area that corresponds to the area wherein the inspection position for the detector 107 can be moved. Furthermore, in this embodiment, at the intervals of printing, a preliminary ejection process for ejecting ink droplets that are not actually employed for printing is performed, so that ink in the periphery of the ejection ports of the print head 102 will not become viscous to cause an ejection failure. During the reciprocal movement of the carriage 101, the carriage 101 is moved over a recovery unit 109 to perform the ejection operation by preliminary ejection operation. During this movement, the carriage 101 is passed by the detector 107, and in this embodiment, also at this timing, detection of the ejection state is performed by the detector 107.

In order to detect the ejection state during the printing operation, first, a value read by a linear encoder is employed to calculate the speed of the carriage 101 required at which the carriage 101 enters the area that corresponds to the movable area of the detector 107. Furthermore, the value read by the linear encoder is also employed to calculate the speed of the carriage 101 at which the carriage 101 exits the area that corresponds to the movable area of the detector 107. In this embodiment, the section above the movable area of the detector 107 is an acceleration/deceleration section for the carriage 101. Therefore, the speed of the carriage 101 that enters the movable area differs from the seed of the carriage 101 that exits the area. The acceleration or deceleration for the carriage 101 is calculated for the movement (the movement in the forward direction) at which the speed of the carriage 101 is to be increased and the movement (the movement in the backward movement) for which the speed of the carriage 101 is to be reduced. Based on the acceleration or deceleration obtained for the carriage 101, the speed of the carriage 101 for each movement is calculated at these times. In this embodiment, the movement in a direction from the recovery unit 109 to the area where a printing medium is set is called a forward movement, and the movement in a direction from the area where a printing medium is set to the recovery unit 109 is called a backward movement.

Before the ink ejection state for the ejection ports is to be examined during the forward movement of the carriage 101, the detector 107 has been moved to the end of the movable range close to the recovery unit 109. The position of the detector 107 at this time is regarded as the initial position. To perform examination for the ejection state, the ejection ports to be examined are passed through the initial position of the detector 107 when the carriage 101 starts moving from the recovery unit 109, or when the scan direction is reversed, instead of moving the carriage 101 to the recovery unit 109.

At the timing at which the carriage 101 is passed through the initial position of the detector 107, ink droplets are ejected from the ejection ports to be examined. Further, at the same time, the detector 107 is moved in the same direction at the same speed of the carriage 101. At this time, a stage drive motor 307 is driven to move the detector 107 at the same speed as the carriage 101. Ink droplets are sequentially ejected from the ejection ports of the ejection port array to be examined, and the ink ejection states are examined. When examination of the ink ejection state is performed for a predetermined number of ejection ports in a period during which the carriage 101 is passed through the movable range of the detector 107, the ejection operation is halted, and the detector 107 is moved to the end of the movable range close to the platen, where a printing medium is set, and moving of the detector 107 is stopped. The position of the detector 107 at this time is regarded as the initial position of the detector 107 for the ejection state examination during the backward movement of the carriage 101.

In this embodiment, when the carriage 101 is passed through the area that corresponds to the range in which the inspection position for the detector 107 can be moved, the inspection position by the detector 107 is moved in accordance with the movement of the carriage 101. At this time, moving of the detector 107 is controlled so that inspection position by the detector 107 corresponds to location of the ejection ports to be examined.

Generally, a period in which the carriage 101 passes through the movable range of the detector 107 is very short. Thus, by only one scanning, detection for the ejection state for all of the ejection ports of a target ejection port array can not be performed. Therefore, in this embodiment, one ejection port array is divided into a plurality of blocks, and the block to be examined is changed for each of a plurality of scans. As a method for determining a block to be detected, the numbers may be allocated to the individual ejection ports, so that examination for the ejection state is performed equally for all of the ejection ports, or that examination of the ejection state is performed preferentially for a block that greatly affect an image to be printed.

As described above, according to this embodiment, the carriage 101 is passed over the detector 107 when the carriage 101 is moved between the area close to the platen where a printing medium is set and the recovery unit 109, and when scanning by using the carriage 101 is performed for the printing operation. At this time, the ink ejection state is examined for the target ejection ports. Therefore, when the examination with respect to the ink ejection state for the ejection ports to be examined is performed, the printing operation need not be stopped. Thus, the period required for detection of the ink ejection state can be reduced, and printing can be efficiently performed. Furthermore, according to the embodiment, since the detector 107 is moved in accordance with the movement of the carriage 101, a detector 107 that provides a wide detection enabled range need not be prepared, and the size of the printing apparatus can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2012-007311 filed Jan. 17, 2012 and 2012-249355 filed Nov. 13, 2012, which are hereby incorporated by reference herein in their entirety.

What is claimed is:

1. An inkjet printing apparatus for performing printing on a printing medium comprising:

a print head including an ejection port array including a plurality of ejection ports to eject ink;

a scanning unit, on which the print head is mounted to perform scanning in a first direction;

an examination unit, including a light source and a light receiving device, for receiving light emitted by the light source, so as to be able to perform examination of an ink ejection state for a target ejection port based on an output change of the light receiving device when an ink droplet ejected from the target ejection port is passed between the light source and the light receiving device; and an inspection position moving unit on which the examination unit is mounted, for moving in the first direction, wherein the inspection position moving unit has positioning accuracy higher than that of the scanning unit.

2. The inkjet printing apparatus according to claim 1, further comprising:

a position acquisition unit for obtaining a stop position for the scanning unit, wherein, when the examination of an ink ejection state is performed, the inspection position moving unit is stopped at an inspection position that is determined based on the stop position obtained by the position acquisition unit.

3. The inkjet printing apparatus according to claim 1, wherein a weight of the print head is greater than a weight of the examination unit.

4. The inkjet printing apparatus according to claim 1, further comprising:

a position acquisition unit for obtaining a stop position of the scanning unit;

an inclination acquisition unit for obtaining an amount of inclination of the print head; and a speed determination unit for determining a moving speed of the inspection position moving unit when the examination of the ink ejection state is performed, based on the stop position obtained by the position acquisition unit, and the amount of inclination.

5. The inkjet printing apparatus according to claim 4, wherein the print head also includes an other ejection port array arranged in parallel to the ejection port array; and wherein the examination unit performs examination of the ink ejection state both for one portion of the ejection port array and one portion of the other ejection port array at the same time.

6. The inkjet printing apparatus according to claim 1, further comprising:

a position acquisition unit for obtaining a stop position of the scanning unit;

an inclination acquisition unit for obtaining an amount of inclination of the print head; and an inspection position determination unit for determining a plurality of inspection positions at which the inspection position moving unit is stopped when the examination of the ink ejection state is performed, based on the stop position obtained by the position acquisition unit, and the amount of inclination.

7. The inkjet printing apparatus according to claim 6, wherein the print head also includes an other ejection port array arranged in parallel to the ejection port array; and wherein the examination unit performs examination of the ink ejection state both for one portion of the ejection port array and one portion of the other ejection port array at the same time.

8. The inkjet printing apparatus according to claim 1, wherein the print head includes an other ejection port array, arranged in parallel to the ejection port array, to eject a different type of ink from that of the ejection port array;

wherein the inkjet printing apparatus further includes a first collection unit for collecting ink that is ejected from the ejection port array when the examination of the ink ejection state is performed, and a second collection unit for collecting ink that is ejected from the other ejection port array when the examination of the ink ejection state is performed.

9. The inkjet printing apparatus according to claim 1, further comprising:

a conveying unit for conveying a printing medium in a second direction crossing to the first direction.

* * * * *